US010632031B2

(12) United States Patent
O'Leary et al.

(10) Patent No.: US 10,632,031 B2
(45) Date of Patent: Apr. 28, 2020

(54) ADJUSTABLE LIFT CHAIR FRAME

(71) Applicant: Pride Mobility Products Corporation, Exeter, PA (US)

(72) Inventors: Robert O'Leary, Scott Township, PA (US); David Burke, Effort, PA (US); Richard Warren, Wyoming, PA (US); Kris Hamby, Wyoming, PA (US); Mike Zablocky, Wyoming, PA (US)

(73) Assignee: Pride Mobility Products Corporation, Exeter, PA (US)

( * ) Notice: Subject to any disclaimer, the term of this patent is extended or adjusted under 35 U.S.C. 154(b) by 0 days.

(21) Appl. No.: 16/106,685

(22) Filed: Aug. 21, 2018

(65) Prior Publication Data

US 2020/0060906 A1 Feb. 27, 2020

(51) Int. Cl.

| | |
|---|---|
| ***A47C 1/00*** | (2006.01) |
| ***A61G 5/14*** | (2006.01) |
| ***A47C 15/00*** | (2006.01) |

(52) U.S. Cl.

CPC ..... *A61G 5/14* (2013.01); *A47C 15/004* (2013.01); *A61G 2200/34* (2013.01)

(58) Field of Classification Search

CPC ..... A47C 1/00; A47C 1/0347; A47C 1/024; A47C 7/506; A61G 5/14; Y10S 297/10

USPC ..... 297/DIG. 10, 338, 340, 311, 339, 335

See application file for complete search history.

(56) References Cited

U.S. PATENT DOCUMENTS

| | | | | |
|---|---|---|---|---|
| 5,333,931 | A * | 8/1994 | Weddendorf | A61G 5/14 297/330 |
| 5,906,416 | A | 5/1999 | Rasmussen | |
| 7,455,360 | B2 * | 11/2008 | White | A61G 5/14 297/321 |
| 7,575,279 | B2 * | 8/2009 | Robertson | A47C 1/0242 297/330 |
| 8,403,409 | B2 * | 3/2013 | Pollard | A47C 1/0355 297/85 M |
| 9,808,385 | B2 * | 11/2017 | Robertson | A47C 1/032 |

(Continued)

FOREIGN PATENT DOCUMENTS

| | | |
|---|---|---|
| GB | 2537527 A | 10/2016 |
| WO | 2017176902 A1 | 10/2017 |

*Primary Examiner* — Chi Q Nguyen

(74) *Attorney, Agent, or Firm* — BakerHostetler

(57) ABSTRACT

A lift chair frame is disclosed having an adjustable seat including a front support bar assembly including a left member and a right member connected to the left member, a rear support bar assembly opposite the front support bar assembly along a longitudinal direction, a left support bar connected to the front and rear support bar assemblies, and a right support bar opposite the left support bar along a lateral direction that is perpendicular to the longitudinal direction and connected to the front and rear support bar assemblies. The lift chair frame also includes an adjustable back coupled to the adjustable seat, where each of the left and right members includes a plurality of alignment features positioned in predetermined locations that correspond to predetermined adjustable seat widths, such that during assembly one of the predetermined adjustable seat widths can be achieved by 1) aligning one of the alignment features of the left member with one of the alignment features of the right member, and 2) securing the left member to the right member.

25 Claims, 15 Drawing Sheets

(56) References Cited

U.S. PATENT DOCUMENTS

| | | | | |
|---|---|---|---|---|
| 10,245,195 | B2 * | 4/2019 | Feldman | A61G 5/14 |
| 2008/0001455 | A1 | 1/2008 | Gong et al. | |
| 2011/0215624 | A1 | 9/2011 | Laslo et al. | |
| 2012/0180832 | A1 * | 7/2012 | Zheng | A45B 17/00 135/20.1 |
| 2012/0193946 | A1 * | 8/2012 | Robertson | A47C 1/03294 297/68 |
| 2014/0035336 | A1 * | 2/2014 | Robertson | A47C 1/032 297/340 |
| 2014/0070585 | A1 * | 3/2014 | LaPointe | A61G 5/14 297/316 |
| 2014/0262566 | A1 | 9/2014 | Davis et al. | |
| 2014/0265497 | A1 * | 9/2014 | Hough | A61G 5/14 297/316 |
| 2016/0206099 | A1 * | 7/2016 | Robertson | A47C 1/03294 |
| 2017/0246060 | A1 * | 8/2017 | Miller | A61G 5/1059 |
| 2018/0042798 | A1 | 2/2018 | Davies | |

* cited by examiner

ADJUSTABLE LIFT CHAIR FRAME

TECHNICAL FIELD

The present invention generally relates to aids and structure to aid people in standing-up. Specifically, the present invention relates to a lift chair frame.

BACKGROUND

For many people, it can be difficult to stand up from a chair. For example, the elderly and people with physical ailments or disabilities may not have the strength or coordination to properly lift themselves out of a chair. To address this problem, power operated lift chairs that transition from a resting position to a standing position may help people easily stand up.

Lift chairs typically include a frame about which cushioning is applied. Often, the frame is a custom-designed structure that is specific to each model and size of lift chair marketed by the manufacturer or brand owner, as the frame must be sufficiently strong to satisfy the desired weight rating and dimensions of the chair while also being sufficiently lightweight for competitive reasons. In practice, manufacturing and designing of lift chair frames have been made more complicated by the quantities of sizes of frames demanded by the users, even while the quantities of each size and model of frame are not large enough to fully automate the manufacturing process via robotics.

SUMMARY

A lift chair frame is provided that simplifies manufacturing and diminishes the number of parts by designing a discrete chair frame, a discrete seat back frame, and a discrete adjustable chair shell frame, each of which is adjustable between predetermined positions such that various desired width, height, and depth dimensions of the lift chair can be achieved via a single set of standardized components. The inventors are unaware of the system or methods claimed herein anywhere in the lift chair industry.

An embodiment of the present disclosure is a lift chair frame comprising an adjustable seat including a front support bar assembly including a left member and a right member connected to the left member, a rear support bar assembly opposite the front support bar assembly along a longitudinal direction, a left support bar connected to the front and rear support bar assemblies, and a right support bar opposite the left support bar along a lateral direction that is perpendicular to the longitudinal direction and connected to the front and rear support bar assemblies. The lift chair frame also includes an adjustable back coupled to the adjustable seat, where each of the left and right members includes a plurality of alignment features positioned in predetermined locations that correspond to predetermined adjustable seat widths, such that during assembly one of the predetermined adjustable seat widths can be achieved by 1) aligning one of the alignment features of the left member with one of the alignment features of the right member, and 2) securing the left member to the right member.

Another embodiment of the present disclosure is a lift chair frame comprising an adjustable back comprising a top support bar assembly, a bottom support bar assembly opposite the top support bar along a vertical direction, a left support bar connected to the top and bottom support bar assemblies, and a right support bar opposite the left support bar along a lateral direction that is perpendicular to the vertical direction and connected to the top and bottom support bar assemblies, where the adjustable back has a first width measured from the left support bar to the right support bar along the lateral direction and a first height measured from the top support bar to the bottom support bar along the vertical direction. The lift chair frame also includes an adjustable seat coupled to the adjustable back, an adjustable chair shell coupled to the adjustable seat, a left wing releasably attachable to the left support bar of the adjustable back, and a right wing releasably attachable to the right support bar of the adjustable back. The adjustable back has a second width measured from the left wing to the right wing along the lateral direction when the left wing is attached to the left support bar and the right wing is attached to the right support bar, the second width being greater than the first width.

A further embodiment of the present disclosure is a lift chair frame that includes an adjustable back comprising a top support bar assembly, a bottom support bar assembly opposite the top support bar along a vertical direction, a left support bar connected to the top and bottom support bar assemblies, and a right support bar opposite the left support bar along the lateral direction that is perpendicular to the vertical direction and connected to the top and bottom support bars, where the adjustable back has a first width measured from the left support bar to the right support bar along the lateral direction and a first height measured from the top support bar to the bottom support bar along the vertical direction. The lift chair frame also includes a left wing releasably attachable to the left support bar of the adjustable back and a right wing releasably attachable to the right support bar of the adjustable back, where the adjustable back has a second width measured from the left wing to the right wing along the lateral direction when the left wing is attached to the left support bar and the right wing is attached to the right support bar, the second width being greater than the first width. The lift chair frame further includes an adjustable seat including a front support bar assembly including a left member and a right member connected to the left member, a rear support bar assembly opposite the front support bar assembly along a longitudinal direction, a left support bar connected to the front and rear support bar assemblies, and a right support bar opposite the left support bar along a lateral direction that is perpendicular to the longitudinal direction and connected to the front and rear support bar assemblies, where each of the left and right members includes a plurality of alignment features positioned in predetermined locations that correspond to predetermined adjustable seat widths, such that during assembly one of the predetermined adjustable seat widths can be achieved by 1) aligning one of the alignment features of the left member with one of the alignment features of the right member, and 2) securing the left member to the right member. The lift chair frame also includes an adjustable chair shell including a left portion, a right portion opposite the left portion along the lateral direction, and a rear portion that attaches the left portion to the right portion, where the adjustable seat is attached to an inner side of the left portion and an inner side of the right portion, where the rear portion includes a left member and a right member connected to the left member, each of the left and right members of the rear portion including a plurality of alignment features positioned in predetermined locations that correspond to predetermined adjustable chair shell widths, such that during assembly one of the predetermined adjustable chair shell widths can be achieved by 1) aligning one of the alignment features of the left member with one of the alignment features of the right member, and 2) securing the left member to the right member.

BRIEF DESCRIPTION OF THE DRAWINGS

The foregoing summary, as well as the following detailed description, will be better understood when read in conjunction with the appended drawings. The drawings show illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
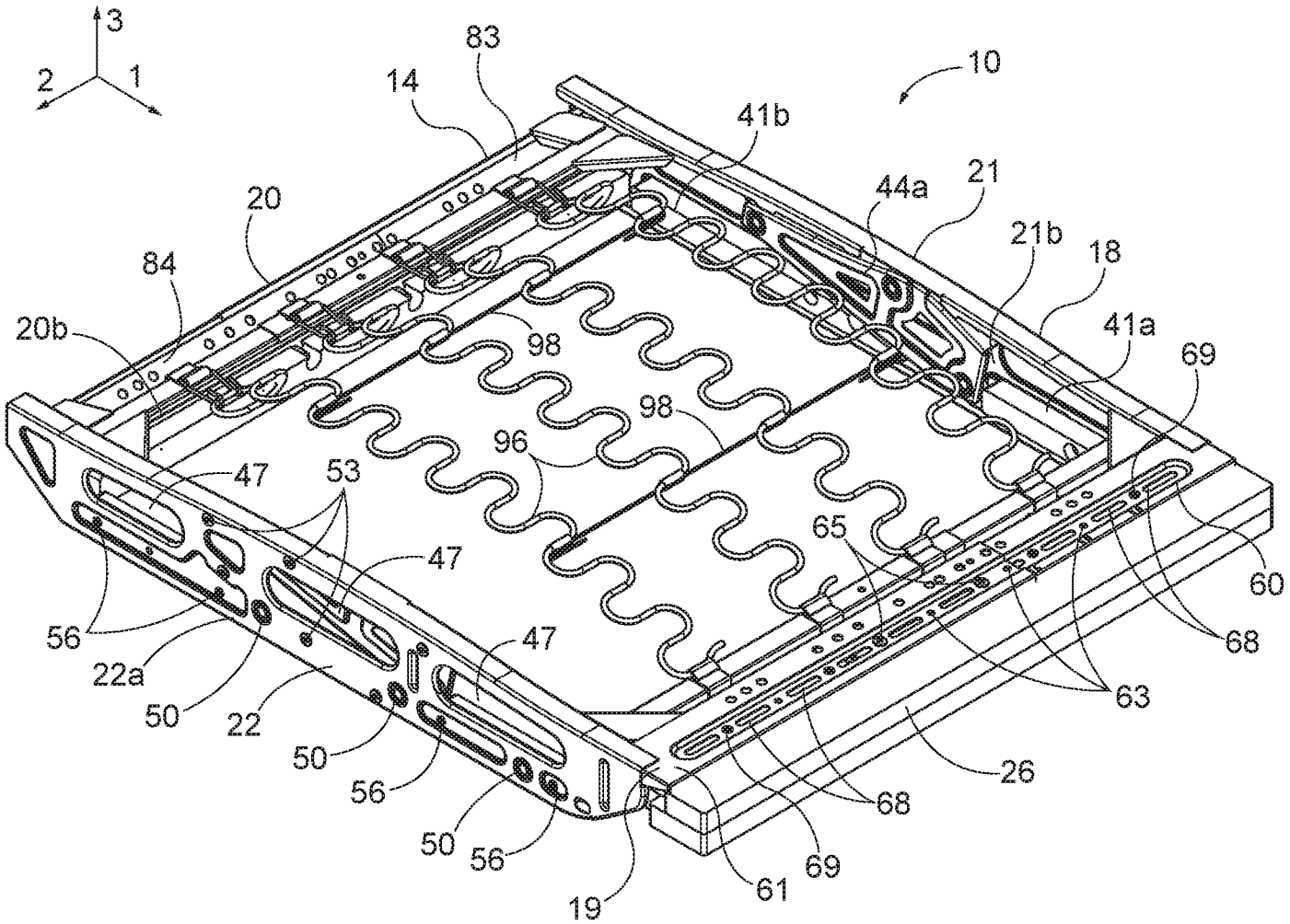
FIG. 1 is a perspective view of an adjustable seat of the lift chair frame according to an embodiment of the present disclosure.
Figure 2:
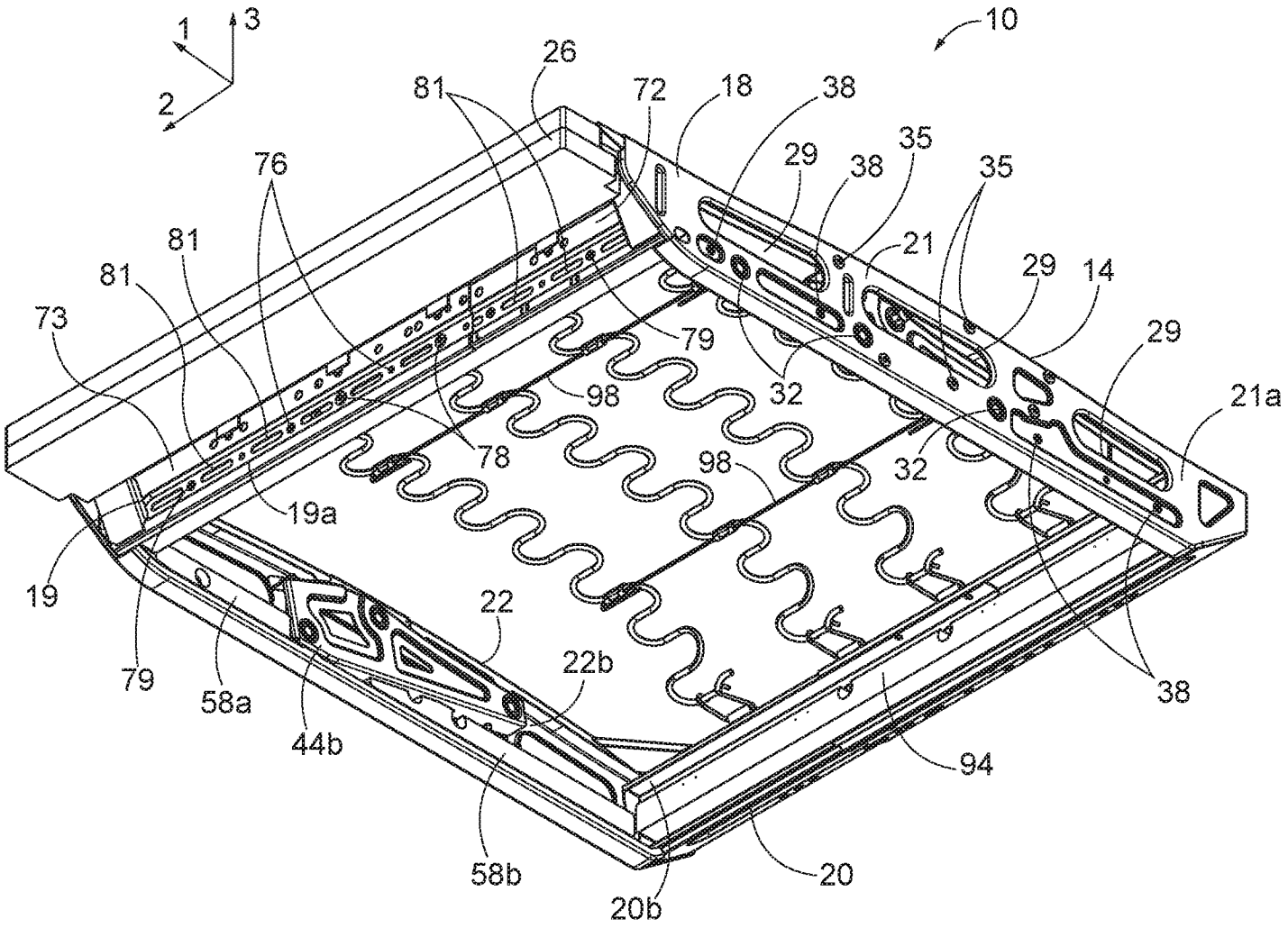
FIG. 2 is an alternative perspective view of the adjustable seat shown in FIG. 1.
Figure 3:
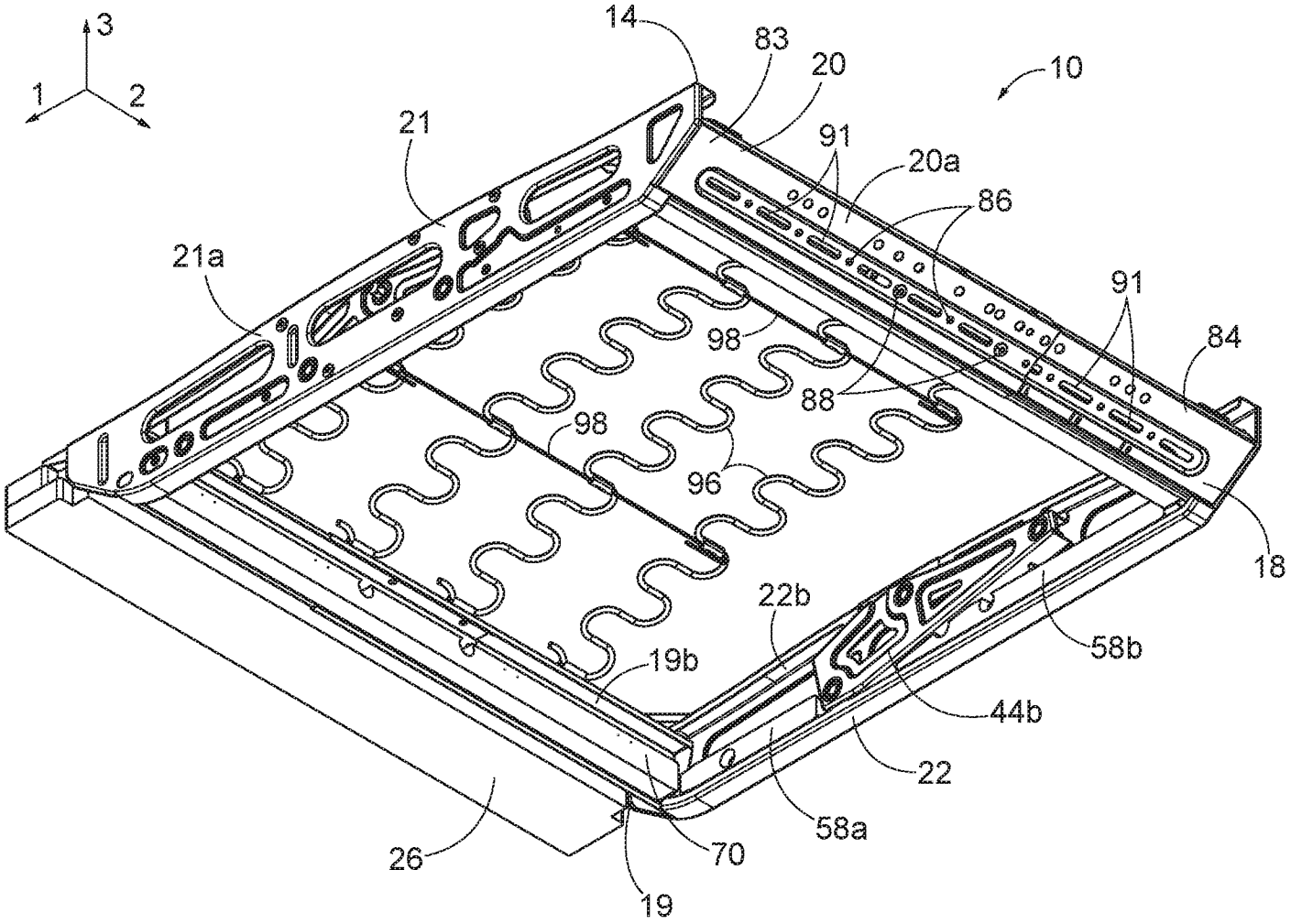
FIG. 3 is a further perspective view of the adjustable seat shown in FIG. 1.

Described herein is a lift chair frame that includes an adjustable seat 10, an adjustable back 100, and an adjustable chair shell 300. The outer appearance of the lift chair may be as shown in U.S. Patent Application Publication No. US2018/0042798A1, which was developed by the assignee of the present invention. Each of the adjustable seat 10, adjustable back 100, and adjustable chair shell 300 can be adjusted so as to change their respective widths, heights, and/or lengths to produce differently sized lift chair frames. Certain terminology is used to describe the lift chair frame in the following description for convenience only and is not limiting. The words "right", "left", "lower," and "upper" designate directions in the drawings to which reference is made. The words "inner" and "outer" refer to directions toward and away from, respectively, the geometric center of the description to describe the lift chair frame and related parts thereof. The words "forward" and "rearward" refer to directions in a longitudinal direction 1 and a direction opposite the longitudinal direction 1 along the lift chair frame and related parts thereof. The terminology includes the above-listed words, derivatives thereof and words of similar import.

Unless otherwise specified herein, the terms "longitudinal," "vertical," and "lateral" are used to describe the orthogonal directional components of various components of the lift chair frame, as designated by the longitudinal direction 1, lateral direction 2, and vertical direction 3. It should be appreciated that while the longitudinal and lateral directions 1, 2 are illustrated as extending along a horizontal plane, and the vertical direction 3 is illustrated as extending along a vertical plane, the planes that encompass the various directions may differ during use.

Referring to FIGS. 1-4C, a the lift chair frame includes an adjustable seat 10 that comprises the portion of the lift chair frame that will directly support the weight of the end user. The adjustable seat 10 has a body 14 that can define a base frame 18. The base frame 18 can include a front support bar assembly 19, a rear support bar assembly 20 opposite the front support bar assembly 19 along the longitudinal direction 1, a left support bar 21 that is connected to the front and rear support bar assemblies 19, 20, and a right support bar 22 that is connected to the front and rear support bar assemblies 19, 20 and is opposite the left support bar 21 along the lateral direction 2. As a result, the base frame 18 can define a substantially hollow, rectangular shape. Each of the front and rear support bar assemblies 19, 20 and the left and right support bars 21, 22 will be discussed individually in greater detail below.

The left support bar 21 can define an outer surface 21*a* and an inner surface 21*b* opposite the outer surface 21*a* along the lateral direction 2. Though it is contemplated that the left support bar 21 can define a substantially continuous, solid body, as depicted the left support bar 21 defines at least one gap 29 that extends completely through the left support bar 21 from the outer surface 21*a* to the inner surface 21*b*. For example, the left support bar 21 can include three gaps 29, though more or less gaps 29 are contemplated. Each of the gaps 29 can be substantially oval shaped, and can allow the left support bar 21 to include less material, thus decreasing its overall weight and manufacturing cost. The left support bar 21 can also include a plurality of bores 32 that extend between the outer and inner surfaces 21*a*, 21*b* of the left support bar 21. Each of the bores 32 can be configured to receive a fastener (not shown) that is configured to secure the left support bar 21, and thus the adjustable seat 10, to another component of the lift chair frame. For example, each fastener can extend through a portion of the adjustable chair shell 300 (discussed below) as well as one of the respective bore 32 to couple the left support bar 21 to the adjustable chair shell 300. However, it is contemplated that each of the bores 32 can receive one of the fasteners to couple the left support bar 21 to another component of the lift chair frame. Each of the bores 32 can be threaded or unthreaded, so as to receive and engage a corresponding threaded or unthreaded fastener. Though the left support bar 21 is depicted as including three bores 32 spaced apart along the longitudinal direction 1, the left support bar 21 can include more or less than three bores 32 that have variable spacing as desired.

The adjustable seat 10 can further include a first left block 41*a* and a second left block 41*b* attached to the inner surface 21*b* of the left support bar 21. Each of the first and second left blocks 41, 41*b* can be comprised of a material capable of being drilled into, such as wood, and can be utilized as a substrate for securing material disposed over the adjustable seat 10, such as padding, fabric, etc. Each of the first and second left blocks 41*a*, 41*b* can be attached to the left support bar 21 using fasteners 38 that extend through the left support bar 21 from the outer surface 21*a* through the inner surface 21*b*. As the first and second left blocks 41*a*, 41*b* can be comprised of wood, each of the fasteners 38 can be wood screws. However, other types of fasteners are contemplated for securing the first and second left blocks 41*a*, 41*b* to the left support bar 21. Each of the first and second left blocks 41*a*, 41*b* are depicted as being attached to the inner surface 21*b* of the left support bar 21 using two fasteners 38, respectively. Alternatively, the left support bar 21 can include more or less blocks that are each attached to the inner surface 21*b* of the left support bar 21 using any number of fasteners 38 as desired. Additionally, the adjustable seat 10 can include a left attachment plate 44*a* secured to the inner surface 21*b* of the left support bar 21. The left attachment plate 44*a* can be either releasably or integrally attached to the left support bar 21, and can serve as an attachment location for attaching the adjustable seat 10 to another component of the lift chair, such as the lift mechanism (not shown) for raising and lowering the lift chair. In the depicted embodiment, the left attachment plate 44*a* is attached to the left support bar 21 between the first and second left blocks 41*a*, 41*b* along the longitudinal direction 1 using fasteners 35 that extend through the outer and inner surfaces 21*a*, 21*b* of the left support bar 21. The fasteners 35 can be threaded screws, bolts, or any other suitable fastener. Though six fasteners 35 are explicitly shown as attaching the left attachment plate 44*a* to the left support bar 21, more or less fasteners 35 can be utilized as desired.

Continuing with FIGS. 1-4C, the right support bar 22 can define an outer surface 22*a* and an inner surface 22*b* opposite the outer surface 22*a* along the lateral direction 2. The inner surface 22*b* of the right support bar 22 can face the inner surface 21*b* of the left support bar 21. Though it is contemplated that the right support bar 22 can define a substantially continuous, solid body, as depicted the right support bar 22 defines at least one gap 47 that extends completely through the right support bar 22 from the outer surface 22*a* to the inner surface 22*b*. For example, the right support bar 22 can include three gaps 47, though more or less gaps 47 are contemplated. Each of the gaps 47 can be substantially oval shaped, and can allow the right support bar 22 to include less material, thus decreasing its overall weight and manufacturing cost. The right support bar 22 can also include a plurality of bores 50 that extend between the outer and inner surfaces 22*a*, 22*b* of the right support bar 22. Each of the bores 50 can be configured to receive a fastener (not shown) that is configured to secure the right support bar 22, and thus the adjustable seat 10, to another component of the lift chair frame. For example, each fastener can extend through a portion of the adjustable chair shell 300 (discussed below) as well as one of the respective bores 50 to couple the right support bar 22 to the adjustable chair shell 300. However, it is contemplated that each of the bores 50 can receive one of the fasteners to couple the right support bar 22 to another component of the lift chair frame. Each of the bores 50 can be threaded or unthreaded, so as to receive and engage a corresponding threaded or unthreaded fastener. Though the right support bar 22 is depicted as including three bores 50 spaced apart along the longitudinal direction 1, the right support bar 22 can include more or less than three bores 50 that have variable spacing as desired.

The adjustable seat 10 can further include a first right block 58*a* and a second right block 58*b* attached to the inner surface 22*b* of the right support bar 22. Each of the first and second right blocks 58*a*, 58*b* can be comprised of a material capable of being drilled into, such as wood, and can be utilized as a substrate for securing material disposed over the adjustable seat 10, such as padding, fabric, etc. Each of the first and second right blocks 58*a*, 58*b* can be attached to the right support bar 22 using fasteners 56 that extend through the right support bar 22 from the outer surface 22*a* to the inner surface 22*b*. As the first and second right blocks 58*a*, 58*b* can be comprised of wood, each of the fasteners 56 can be wood screws. However, other types of fasteners are contemplated for securing the first and second right blocks 58*a*, 58*b* to the right support bar 22. Each of the first and second right blocks 58*a*, 58*b* are depicted as being attached to the inner surface 22*b* of the right support bar 22 using two fasteners 56, respectively. Alternatively, the right support bar 22 can include more or less blocks that are each attached to the inner surface 22*b* of the right support bar 22 using any number of fasteners 56 as desired. Additionally, the adjustable seat 10 can include a right attachment plate 44*b* secured to the inner surface 22*b* of the right support bar 22. The right attachment plate 44*b* can be either releasably or integrally attached to the right support bar 22, and can serve as an attachment location for attaching the adjustable seat 10 to another component of the lift chair, such as the lift mechanism (not shown) for raising and lowering the lift chair. In the depicted embodiment, the right attachment plate 44*b* is attached to the right support bar 22 between the first and second right blocks 58*a*, 58*b* along the longitudinal direction 1 using fasteners 53 that extend through the outer and inner surface 22*a*, 22*b* of the right support bar 22. The fasteners 53 can be threaded screws, bolts, or any other suitable fastener. Though six fasteners 53 are explicitly shown as attaching the right attachment plate 44*b* to the right support bar 22, more or less fasteners 53 can be utilized as desired.

With continued reference to FIGS. 1-4C, the front support bar assembly 19 can define an outer surface 19*a* and an inner surface 19*b* opposite the outer surface 19*a* along the longitudinal direction 1. Front support bar assembly 19 includes multiple sections coupled together, which in the embodiment shown in the figures is unlike the unitary, single-piece left and right support bars 21, 22. As depicted, the front support bar assembly 19 includes a lower left member 72 and a lower right member 73 releasably connected to the lower left member 72, where the lower left member 72 is connected to the left support bar 21 and the lower right member 73 is connected to the right support bar 22. The lower left member 72 and the lower right member 73 can have complementary shapes to partially overlap each other for connecting to each other, as will be discussed below. The lower left and lower right members 72, 73 can collectively define the inner and outer surfaces 19*a*, 19*b* of the front support bar assembly 19. Each of the lower left and lower right members 72, 73 can include at least one gap 81 that extends through their respective bodies. For example, each of the lower left and lower right members 72, 73 can define six substantially slotted holes or oval gaps 81. However, more or less gaps 81 are contemplated, as well as gaps 81 having different shapes and sizes. The gaps 81, like the gaps 29 and 47, allow the front support bar assembly 19 to include less material, thus decreasing the overall weight and manufacturing cost associated with the front support bar assembly 19.

Each of the lower left and lower right members 72, 73 include a plurality of alignment features positioned in predetermined locations that correspond to predetermined widths of the adjustable seat 10. In the depicted embodiment, the alignment features are a plurality of alignment bores 76 that extend completely through the respective lower left and lower right member 72, 73. However, other types of alignment features are contemplated, such as slot and groove attachment, press-fit features, ball detents, etc. As depicted, each of the lower left and lower right members 72, 73 includes seven alignment bores 76, and each of the alignment bores 76 is spaced apart by a gap 81. However, both of the lower left and lower right members 72, 73 can include more or less alignment bores 76, as well as different arrangements of alignment bores 76 as desired. Each of the alignment bores 76 can be sized to receive an adjustment fastener 78, which can be a screw, bolt, or other suitable fastener. In operation, securing the lower left and lower right members 72, 73 to each other during assembly by inserting the adjustment fasteners 78 through predetermined combinations of the alignment bores 76 can be utilized to adjust the width of the adjustable seat 10. In this regard, the lower left and lower right members 72, 73 can be positioned relative to each other such that one of the alignment bores 76 of the lower left member 72 is aligned with one of the alignment bores 76 of the lower right member 73 to define a first configuration that defines a first width $W_1$ (FIG. 4A) measured from the outboard surface of left support bar 21 to the outboard surface of right support bar 22 along the lateral direction 2. Then, an adjustment fastener 78 can be inserted through the respective alignment bores 76 of the lower left and lower right members 72, 73 to secure these components together.

Alternatively, the lower left and lower right members 72, 73 can be positioned relative to each other such that one of the alignment bores 76 of the lower left member 72 is aligned with another one of the alignment bores 76 of the lower right member 73 in a second configuration. When the lower left and lower right members 72, 73 are in the second configuration, inserting the adjustment fastener 78 through a second set of the alignment bores 76 of the lower left and lower right members 72, 73 can secure the lower left and lower right members 72, 73 to each other, such that the adjustable seat 10 defines a second width W2 (FIG. 4B) measured from the left support bar 21 to the right support bar 22 along the lateral direction 2. This process can be similarly performed during assembly such that the adjustable seat 10 is in a third configuration and defines a third width W3 (FIG. 4C), or any number of configurations and corresponding widths as desired. Further, when the adjustable seat 10 is in any of the first, second, or third configurations, any number of adjustment fasteners 78 can be inserted through the alignment bores 76 to secure the lower left and lower right members 72, 73 to each other. In the depicted embodiment, four adjustment fasteners 78 are utilized.

The adjustable seat 10 can also include an inner front block 70 attached to the inner surface 19*b* of the front support bar assembly 19. Like the first and second left and right blocks 41*a*, 41*b*, 58*a*, 58*b*, the inner front block 70 can be comprised of a material capable of being drilled into, such as wood, and can be utilized as a substrate for securing material disposed over the adjustable seat 10, such as padding, fabric, etc. The inner front block 70 is depicted as extending substantially the width of the front support bar assembly 19, though the inner front block 70 can be small or larger as desired. The inner front block 70 can be attached to both the lower left and lower right member 72, 73 of the front support bar assembly 19 via fasteners 79. The fasteners 79 can extend through alignment bores 76 of the lower left and lower right members 72, 73 of the front support bar assembly 19 that are not be used to couple the lower left and lower right members 72, 73 together, though it is contemplated that the front support bar assembly 19 can include dedicated bores for receiving the fasteners 79. The fasteners 79 can comprise threaded screws, bolts, or other suitable fastening devices. Two fasteners 79 are depicted as being utilized to secure the inner front block 70 to the lower left and lower right members 72, 73, though any other number of fasteners 79 can alternatively be used.

Though the adjustable seat 10 is depicted as including blocks 41*a*, 41*b*, 58*a*, 58*b*, and 70, as well as front block 26 (described below) for securing material disposed over the adjustable seat 10, it is contemplated that in other embodiments the adjustable seat 10 will have none of these features. In contrast, such an alternative adjustable seat 10 can be configured such that the front support bar assembly 19, rear support bar assembly 20, left support bar 21, and/or right support bar 22 can receive one or more hooks or other similar feature attached directly to the material to be disposed over the adjustable seat 10, where the material can be a padding, fabric, etc. Although specific portions of the adjustable seat 10 are mentioned, it is contemplated that any portion of the adjustable seat 10 can receive such a hook. Though the hooks may be comprised of plastic, any conventional hook may be utilized.

In addition to the lower left and right members 72, 73, the front support bar assembly 19 can include an upper left member 60 and an upper right member 61 releasably coupled to the upper left member 60. The upper left member 60 can be coupled to and extend from the top of the lower left member 72, as well as coupled to the left support bar 21. Conversely, the upper right member 61 can be coupled to and extend from the top of the lower right member 73, as well as coupled to the right support bar 22. The upper left member 60 and the upper right member 61 can at least partially overlap each other for connecting to each other, as will be discussed below. Like the other components of the adjustable seat 10, each of the upper left and upper right members 60, 61 can define at least one gap 68 that extends through their respective bodies. For example, each of the upper left and upper right members 60, 61 can define six substantially oval gaps 68. However, more or less gaps 68 are contemplated, as well as gaps 68 having different shapes and sizes. The gaps 68, along with the gaps 81, allow the front support bar assembly 19 to include less material, thus decreasing the overall weight and manufacturing cost associated with the front support bar assembly 19.

Figure 4C:
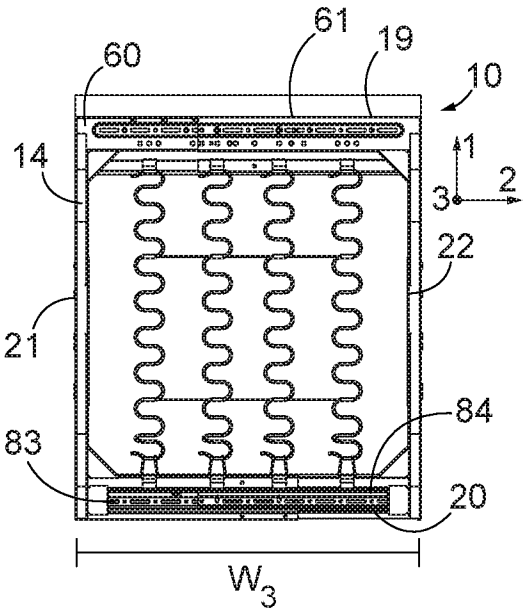
FIG. 4C is a top view of the adjustable seat shown in FIG. 1 adjusted to a third configuration.
Figure 4B:
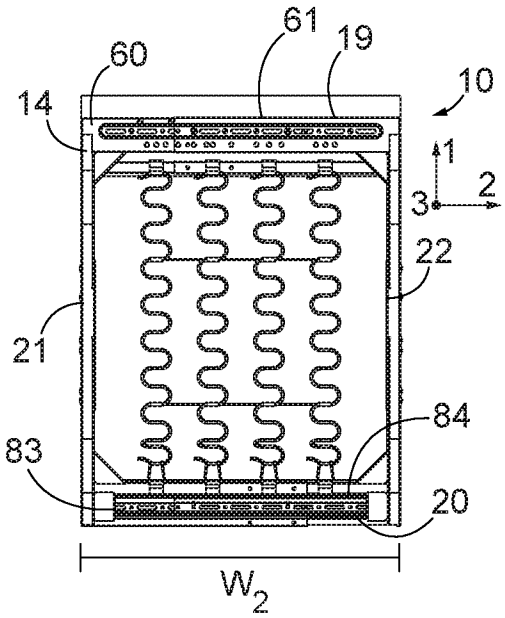
FIG. 4B is a top view of the adjustable seat shown in FIG. 1 adjusted to a second configuration.
Figure 4A:
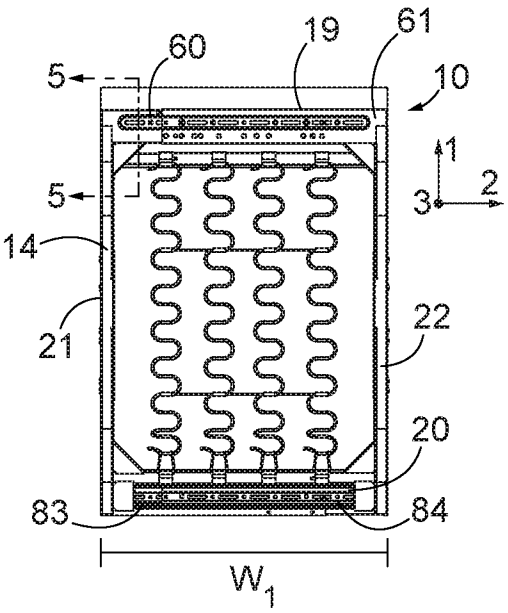
FIG. 4A is a top view of the adjustable seat shown in FIG. 1 adjusted to a first configuration.

Each of the upper left and upper right members 60, 61 include a plurality of alignment features positioned in predetermined locations that correspond to predetermined widths of the adjustable seat 10. In the depicted embodiment, the alignment features are a plurality of alignment bores 63 that extend completely through the respective upper left and upper right members 60, 61. However, other types of alignment features are contemplated, such as slot and groove attachment, press-fit features, ball detents, etc. As depicted, each of the upper left and upper right members 60, 61 includes seven alignment bores 63, and each of the alignment bores 63 is spaced apart by a gap 68. However, both of the upper left and upper right members 60, 61 can include more or less alignment bores 63, as well as different arrangements of alignment bores 63 as desired. Each of the alignment bores 63 can be sized to receive an adjustment fastener 65, which can be a screw, bolt, or other suitable fastener. In operation, securing the upper left and upper right members 60, 61 to each other during assembly by inserting the adjustment fasteners 65 through predetermined combinations of the alignment bores 63 can be utilized to adjust the width of the adjustable seat 10. In this regard, the upper left and upper right members 60, 61 can be positioned relative to each other such that the one of the alignment bores 63 of the upper left member 60 is aligned with one of the alignment bores 63 of the upper right member 61 in a first configuration. When the upper left and upper right members 60, 61 are in the first configuration, inserting the adjustment fasteners 65 through a first set of the alignment bores 63 of the upper left and upper right members 60, 61 can secure the upper left and upper right members 60, 61 to each other, such that the adjustable seat 10 defines a first width $W_1$ (FIG. 4A).

Alternatively, the upper left and upper right members 60, 61 can be positioned relative to each other such that one of the alignment bores 63 of the upper left member 60 is aligned with another one of the alignment bores 63 of the upper right member 61 in a second configuration. When the upper left and upper right members 60, 61 are in the second configuration, inserting the adjustment fastener 65 through a second set of the alignment bores 63 of the upper left and upper right members 60, 61 can secure the upper left and upper right members 60, 61 to each other such that the adjustable seat 10 defines a second width W2 (FIG. 4B). This process can be similarly performed such that the adjustable seat 10 is in a third configuration and defines a third width W3 (FIG. 4C), or any number of configurations and corresponding widths as desired. Further, when the adjustable seat 10 is in any of the first, second, or third configurations, any number of adjustment fasteners 65 can be inserted through the alignment bores 63 to secure the upper left and upper right members 60, 61 to each other. In the depicted embodiment, two adjustment fasteners 65 are utilized.

The adjustable seat 10 can also include a front block 26 attached to the bottom of the upper left and upper right members 60, 61 of the front support bar assembly 19. Like the inner front block 70, the front block 26 can be comprised of a material capable of being drilled into, such as wood, and can be utilized as a substrate for securing material disposed over the adjustable seat 10, such as padding, fabric, etc. The front block 26 is depicted as extending substantially the width of the upper left and upper right members 60, 61, though the front block 26 can be smaller or larger as desired. The front block 26 can be attached to both the upper left and upper right members 60, 61 of the front support bar assembly 19 via fasteners 69. The fasteners 69 can extend through adjustment bores 63 of the upper left and upper right members 60, 61 of the front support bar assembly 19 that are not being used to couple the upper left and upper right members 60, 61 together, though it is contemplated that the front support bar assembly 19 can include dedicated bores for receiving the fasteners 69. Two fasteners 69 are depicted as being utilized to secure the front block 26 to the upper left and upper right members 60, 61, though any other number of fasteners 69 can alternatively be used.

Continuing with FIGS. 1-4C, opposite the front support bar assembly 19 the rear support bar assembly 20 can define an outer surface 20*a* and an inner surface 20*b* opposite the outer surface 20*a* along the longitudinal direction 1, where the inner surface 20*b* can substantially face the inner surface 19*b* of the front support bar assembly 19. Like the front support bar assembly 19, the rear support bar assembly 20 defines multiple sections releasably coupled to each other. As depicted, the rear support bar assembly 20 includes a left member 83 and a right member 84 releasably connected to the left member 83, where the left member 83 is connected to the left support bar 21 and the right member 84 is connected to the right support bar 22. The left and right members 83, 84 can collectively define the inner and outer surfaces 20*a*, 20*b* of the rear support bar assembly 20. The left and right members 83, 84 can also at least partially overlap each other for connecting to each other, as will be discussed below. Each of the left and right members 83, 84 can include at least one gap 91 that extends through their respective bodies. For example, each of the left and right members 83, 84 can define six substantially oval gaps 91. However, more or less gaps 91 are contemplated, as well as gaps 91 having different shapes and sizes. The gaps 91, like the gaps 81, allow the rear support bar assembly 20 to include less material, thus decreasing the overall weight and manufacturing cost associated with the rear support bar assembly 20.

Each of the left and right members 83, 84 includes a plurality of alignment features positioned in predetermined locations that correspond to predetermined widths of the adjustable seat 10. In the depicted embodiment, the alignment features are a plurality of alignment bores 86 that extend completely through the respective left and right members 83, 84. However, other types of alignment features are contemplated, such as slot and groove attachment, press-fit features, ball detents, etc. As depicted, each of the left and right members 83, 84 includes seven alignment bores 86, and each of the alignment bores 86 is spaced apart by a gap 91. However, both of the left and right members 83, 84 can include more or less alignment bores 86, as well as different arrangements of alignment bores 86 as desired. Each of the alignment bores 86 can be sized to receive an adjustment fastener 88, which can be a screw, bolt, or other suitable fastener. In operation, securing the left and right members 83, 84 to each other during assembly by inserting the adjustment fasteners 88 through predetermined combinations of the alignment bores 86 can be utilized to adjust the width of the adjustable seat 10. In this regard, the left and right members 83, 84 can be positioned relative to each other such that one of the alignment bores 86 of the left member 83 is aligned with one of the alignment bores 86 of the right member 84 in a first configuration. When the left and right members 83, 84 are in the first configuration, inserting the adjustment fasteners 88 through a first set of the alignment bores 86 of the left and right members 83, 84 can secure the left and right members 83, 84 to each other, such that the adjustable seat 10 defines a first width $W_1$ (FIG. 4A).

Alternatively, the left and right members 83, 84 can be positioned relative to each other such that one of the alignment bores 86 of the left member 83 is aligned with another one of the alignment bores 86 of the right member 84 in a second configuration. When the left and right members 83, 84 are in the second configuration, inserting the adjustment fastener 88 through a second set of the alignment bores 86 of the left and right members 83, 84 can secure the left and right members 83, 84 to each other, such that the adjustable seat 10 defines a second width W2 (FIG. 4B). This process can be similarly performed such that the adjustable seat 10 is in a third configuration and defines a third width W3 (FIG. 4C), or any number of configurations and corresponding widths as desired. Further, when the adjustable seat 10 is in any of the first, second, or third configurations, any number of adjustment fasteners 88 can be inserted through the alignment bores 86 to secure the left and right members 83, 84 to each other. In the depicted embodiment, two adjustment fasteners 88 are utilized.

The adjustable seat 10 can also include an inner rear block 94 attached to the inner surface 20*b* of the rear support bar assembly 20. Like the inner front block 70, the inner rear block 94 can be comprised of a material capable of being drilled into, such as wood, and can be utilized as a substrate for securing material disposed over the adjustable seat 10, such as padding, fabric, etc. The inner rear block 94 is depicted as extending substantially from the left support bar 21 to the right support bar 22, though the inner rear block 94 can be smaller or larger as desired. The inner rear block 94 can be attached to both the left and right members 83, 84 of the rear support bar assembly 20 via fasteners (not shown). The fasteners can extend through alignment bores 86 of the left and right members 83, 84 of the rear support bar assembly 20 that are not being used to couple the left and right members 83, 84 together, though it is contemplated that the rear support bar assembly 20 can include dedicated bores for receiving the fasteners.

To support a seat cushion or other material disposed on top of the adjustable seat 10, the adjustable seat 10 can comprise a plurality of wires 96 that extend from the front support bar assembly 19 to the rear support bar assembly 20. Each of the wires 96 can be spaced apart along the lateral direction 2, and can comprise a flexible metal that can deform under the weight of a cushion and a user seated upon the cushion and adjustable seat 10. Though four wires 96 in particular are shown, the adjustable seat 10 can include more or less as desired. Further, the adjustable seat 10 can include cross members 98 that extend between and link the wires 96. The cross members 98 can also comprise a flexible metal, and can be utilized to prevent the wires from deforming excessively in relation to each other.

Figure 5:
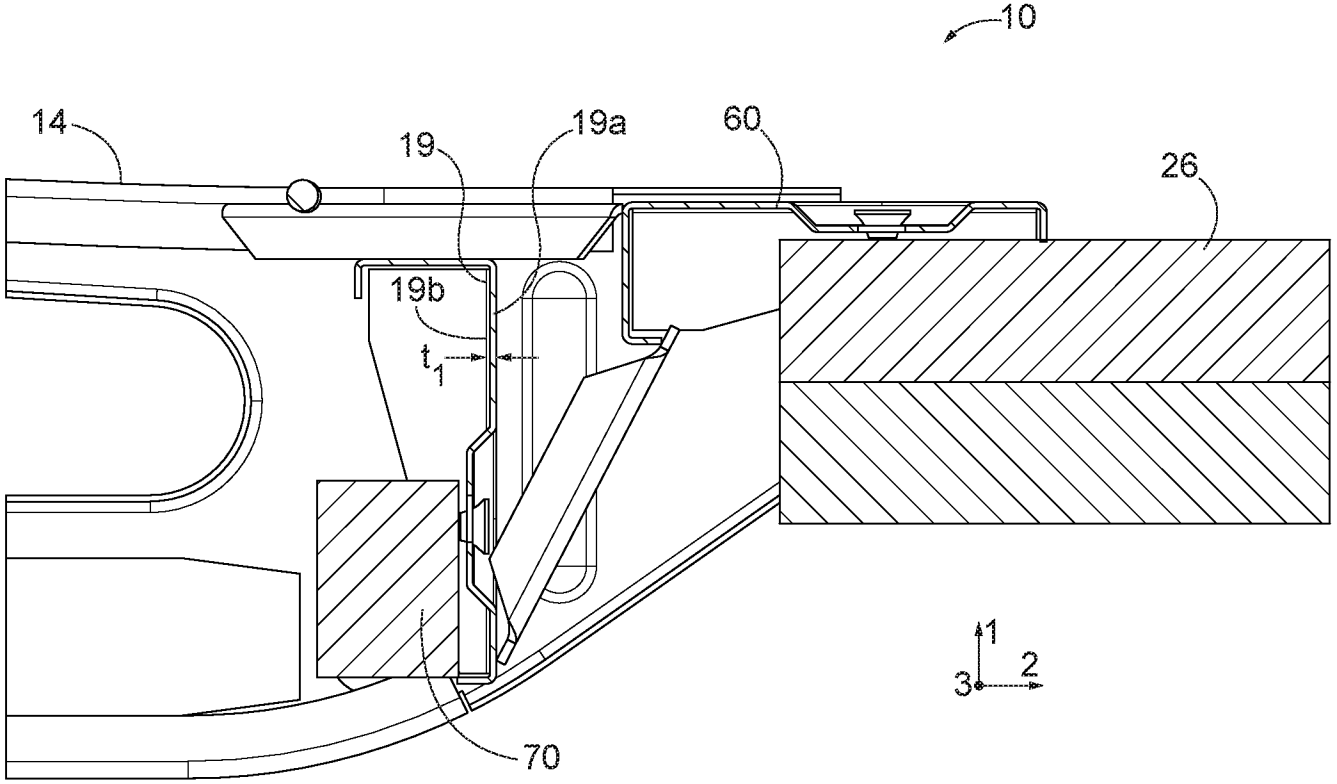
FIG. 5 is a cross-sectional view of the adjustable seat shown in FIG. 1, taken along FIG. 5-5 shown in FIG. 4A.

Referring to FIG. 5, a cross-sectional view of the lower left member 72 of the front support bar assembly 19 is shown in cross section. As shown, the lower left member 72 can define a thickness $t_1$ that extends from the outer surface 19*a* to the inner surface 19*b* along the longitudinal direction 1. The thickness $t_1$ can be from about 0.8 mm to about 1.2 mm. For example, in one embodiment the thickness $t_1$ is about 0.8 mm. In another embodiment, the thickness $t_1$ can be about 1.2 mm. Though the thickness of the lower left member 72 is explicitly shown, each of the other portions of the body 14 of the adjustable seat 10 can define a similar thickness $t_1$. Also, each element of the body 14 of the adjustable seat 10 can be comprised of a stamped and/or bent sheet metal. For example, each component of the adjustable seat 10 can be comprised of steel. Different metals and thicknesses can be utilized in the body 14 of the adjustable seat 10, so long as the moment of inertia provides sufficient bending strength.

Now referring to FIGS. 6-8, the adjustable back 100 will be described. The adjustable back 100 can be attached to and extend upwards from the rear portion of the adjustable seat 10, and comprises the portion of the lift chair that will directly support the back of the end user. The adjustable back 100 can include several parts that are releasably coupled to each other. The primary component of the adjustable back 100 is the back base 102. The adjustable back 100 can also comprise a right wing 106*a* attached to the right side of the back base 102, a left wing 106*b* attached to the left side of the back base 102, and an upper wing 106*c*. When the right, left, and upper wings 106*a*-106*c* are detached from the back base 102, the adjustable back 100 can define a first width $W_4$ and a first height $H_1$. However, when the right, left, and upper wings 106*a*-106*c* are attached to the back base 102, the adjustable back 100 can define a second width $W_5$ and a second height $H_2$, as will be described further below.

The back base 102 of the adjustable back 100 can include a top support bar assembly 110, a bottom support bar assembly 114 opposite the top support bar assembly 110 along the vertical direction 3, a left support bar 118 that is connected to the top and bottom support bar assemblies 110, 114, and a right support bar 122 opposite the left support bar 118 along the lateral direction 2 and connected to the top and bottom support bar assemblies 110, 114. As a result, the adjustable back 100 can define a substantially hollow, rectangular shape. The adjustable back 100 can further include a central support bar assembly 126 that is connected to the left and right support bars 118, 122 and is positioned between the top and bottom support bar assemblies 110, 114 along the vertical direction 3. Each of the top, bottom, and central support bar assemblies 110, 114, 126 and the left and right support bars 118, 122 will be discussed individually below in greater detail.

Figure 6:
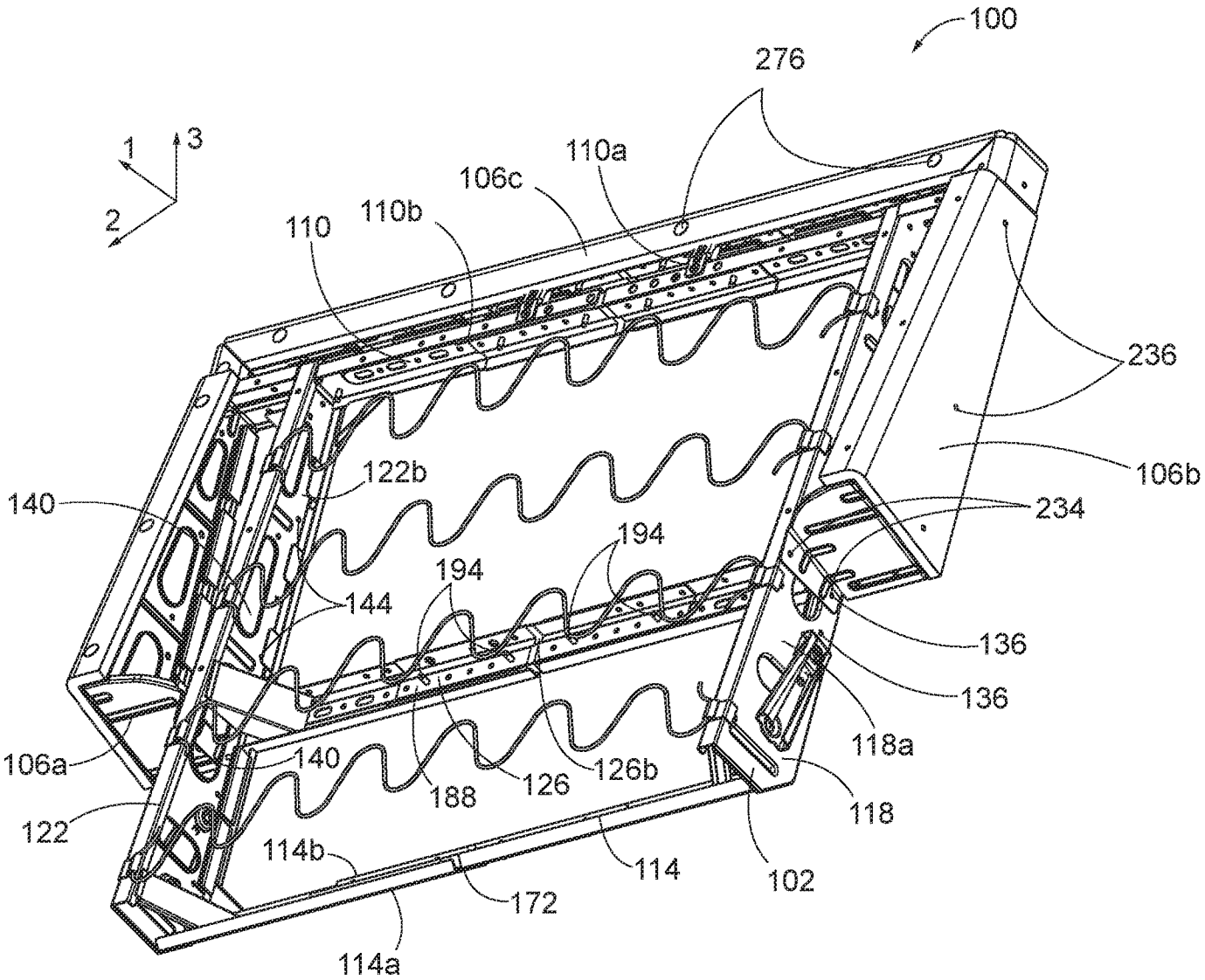
FIG. 6 is a perspective view of an adjustable back of the lift chair frame according to an embodiment of the present disclosure.
Figure 7:
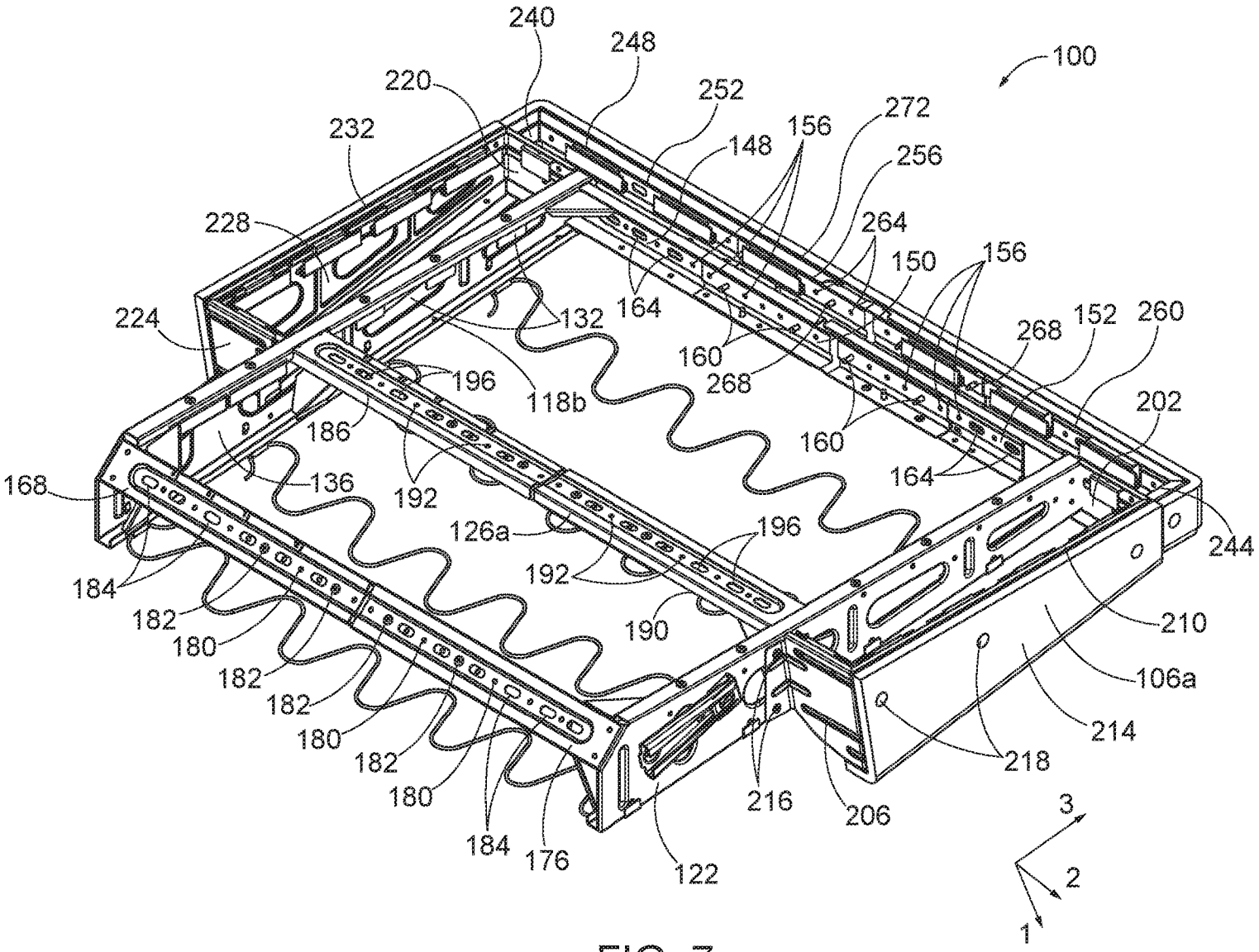
FIG. 7 is an alternative perspective view of the adjustable back shown in FIG. 6.
Figure 8:
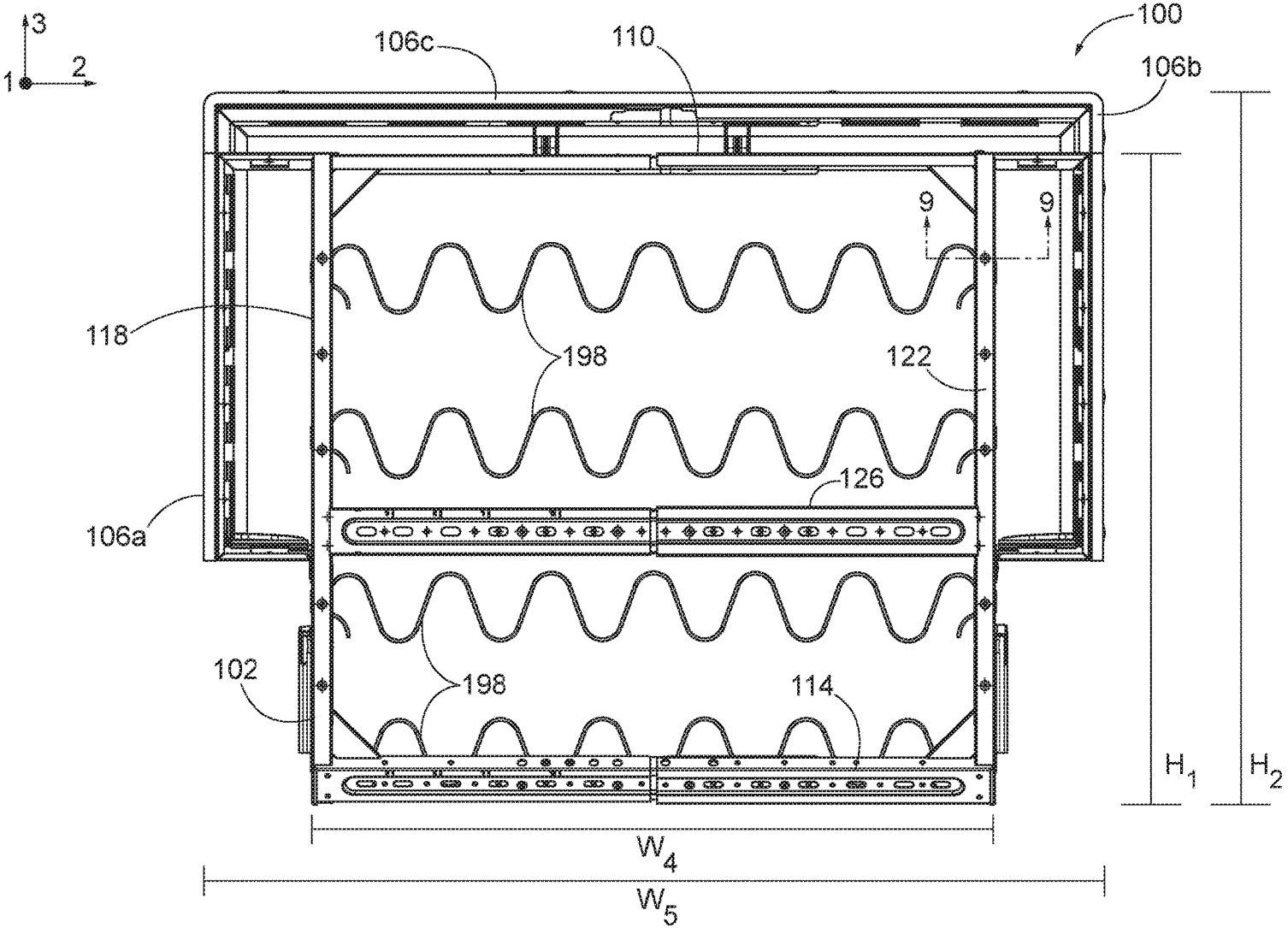
FIG. 8 is a rear view of the adjustable back shown in FIG. 6.

Continuing with FIGS. 6-8, the top support bar assembly 110 can define an outer surface 110*a* and an inner surface 110*b* opposite the outer surface 110*a* along the vertical direction 3. The top support bar assembly 110 can be a unitary, continuous structure, or can include multiple sections coupled to each other. As depicted, the top support bar assembly 110 includes three segments: a left member 148, a right member 152, and a central member 150 that overlaps the left and right members 148, 152 and couples the left and right members 148, 152 to each other. Though the top support bar assembly 110 is specifically shown as comprising three sections, more or less sections can be included as desired. Each of the left and right members 148, 152 can define a plurality of substantially oval gaps 164 that extend completely through the left and right members 148, 152. The gaps 164, like the other gaps described above, allow the top support bar assembly 110 to include less material, thus decreasing the overall weight and manufacturing cost associated with the top support bar assembly 110. Though the central member 150 of the top support bar assembly 110 is not depicted as including any gaps 164, it is contemplated that the central member 150 can include any number of gaps 164 in other embodiments.

Each of the left, central, and right members 148, 150, 152 of the top support bar assembly 110 includes a plurality of alignment features positioned in predetermined locations that correspond to predetermined widths of the adjustable back 100. In the depicted embodiment, the alignment features are a plurality of alignment bores 156 that extend completely through the respective left, central and right members 148, 150, 152. However, other types of alignment features are contemplated, such as slot and groove attachment, press-fit features, ball detents, etc. Each of the alignment bores 156 can be sized to receive a fastener 160, which can be a screw, bolt, or other suitable fastener for securing the left, central, and right members 148, 150, and 152 to each other. In operation, the central member 150 overlaps part of left member 148 and part of the right member 152, such that at least one of the alignment bores 156 of the central member 150 is aligned with at least one of the alignment bores 156 of the left member 148, and at least one of the alignment bores 156 of the central member 150 is aligned with at least one of the alignment bores 156 of the right member 152. Securing the left, central, and right members 148, 150, 152 to each other during assembly by inserting adjustment fasteners 160 through predetermined combinations of the alignment bores 156 can be utilized to adjust the width of the adjustable back 100. The alignment of a set of the alignment bores 156 of the central member 150 with one of the alignment bores 156 of the left member 148 and one of the alignment bores 156 of the right member 152 allows the alignment bores 156 to receive fasteners 160 that secure the left, central, and right members 148, 150, 152 to each other such that the adjustable back has a first width. The alignment of a set of the alignment bores 156 of the central member 150 with another one of the alignment bores 156 of the left member 148 and another one of the alignment bores 156 of the right member 152 allows the bores to receive fasteners 160 that secure the left, central, and right members 148, 150, 152 to each other such that the adjustable back has a second width that is different than the first width. In the depicted embodiment, two fasteners 160 are shown securing the left and central members 148, 150 to each other and two fasteners 160 are shown securing the central and right members 150, 152 to each other. However, more or less fasteners 160 can be utilized to secure the left, central, and right members 148, 150, 152 to each other as desired.

The bottom support bar assembly 114 can be similarly configured as the top support bar assembly 110. The bottom support bar assembly 114 can define an outer surface 114*a* and an inner surface 114*b* opposite the outer surface 114*a* along the longitudinal and vertical directions 1, 3. The bottom support bar assembly 114 can be a unitary, continuous structure, or can include multiple sections coupled to each other. As depicted, the bottom support bar assembly 114 includes three segments: a left member 168, a central member 172, and a right member 176 that overlaps the left and right members 168, 176 and couples the left and right members 168, 176 to each other. Though the bottom support bar assembly 114 is specifically shown as comprising three sections, more or less sections can be included as desired. Each of the left and right members 168, 176 can define a plurality of substantially oval gaps 184 that extend completely through the left and right members 168, 176. The gaps 184, like the other gaps described above, allow the bottom support bar assembly 114 to include less material, thus decreasing the overall weight and manufacturing cost associated with the bottom support bar assembly 114. Though the central member 172 of the bottom support bar assembly 114 is not depicted as including any gaps 184, it is contemplated that the central member 172 can include any number of gaps 184 in other embodiments.

Each of the left, central, and right members 168, 172, 176 of the bottom support bar assembly 114 includes a plurality of alignment features positioned in predetermined locations that correspond to predetermined widths of the adjustable back 100. In the depicted embodiment, the alignment features are a plurality of alignment bores 180 that extend completely through the respective left, central and right members 168, 172, 176. However, other types of alignment features are contemplated, such as slot and groove attachment, press-fit features, ball detents, etc. Each of the alignment bores 180 can be sized to receive a fastener 182, which can be a screw, bolt, or other suitable fastener for securing the left, central, and right members 168, 172, 176 to each other. In operation, the central member 172 overlaps part of left member 168 and part of the right member 176, such that at least one of the alignment bores 180 of the central member 172 is aligned with at least one of the alignment bores 180 of the left member 168, and at least one of the alignment bores 180 of the central member 172 is aligned with at least one of the alignment bores 180 of the right member 176. Securing the left, central, and right members 168, 172, 176 to each other during assembly by inserting adjustment fasteners 182 through predetermined combinations of the alignment bores 180 can be utilized to adjust the width of the adjustable back 100. The alignment of a set of the alignment bores 180 of the central member 172 with one of the alignment bores 180 of the left member 168 and one of the alignment bores 180 of the right member 176 allows the alignment bores 180 to receive a fastener 182 that secures the left, central, and right members 168, 172, 176 to each other such that the adjustable back 100 has a first width. The alignment of a set of the alignment bores 180 of the central member 172 with another one of the bores of the left member 168 and another one of the alignment bores 180 of the right member 176 allows the alignment bores 180 to receive fasteners 182 that secure the left, central, and right members 168, 172, 176 to each other such that the adjustable back 100 has a second width that is different than the first width. In the depicted embodiment, two fasteners 182 are shown securing the left and central members 168, 172 to each other and two fasteners 182 are shown securing the central and right members 172, 176 to each other. However, more or less fasteners 182 can be utilized to secure the left, central, and right members 168, 172, 176 to each other as desired.

In addition to the bottom support bar assembly 114, the central support bar assembly 126 can be similarly configured as the top support bar assembly 110. The central support bar assembly 126 can define an outer surface 126*a* and an inner surface 126*b* opposite the outer surface 126*a* along the longitudinal direction 1. The central support bar assembly 126 can be a unitary, continuous structure, or can include multiple sections coupled to each other. As depicted, the central support bar assembly 126 includes three segments: a left member 186, a right member 190, and a central member 188 that overlaps the left and right members 186, 190 and couples the left and right members 186, 190 to each other. Though the central support bar assembly 126 is specifically shown as comprising three sections, more or less sections can be included as desired. Each of the left and right members 186, 190 can define a plurality of substantially oval gaps 196 that extend completely through the left and right members 186, 190. The gaps 196, like the other gaps described above, allow the central support bar assembly 126 to include less material, thus decreasing the overall weight and manufacturing cost associated with the central support bar assembly 126. Though the central member 188 of the central support bar assembly 126 is not depicted as including any gaps 196, it is contemplated that the central member 188 can include any number of gaps 196 in other embodiments.

Each of the left, central, and right members 186, 188, 190 of the central support bar assembly 126 includes a plurality of alignment features positioned in predetermined locations that correspond to predetermined widths of the adjustable back 100. In the depicted embodiment, the alignment features are a plurality of alignment bores 192 that extend completely through the respective left, central and right members 186, 188, 190. However, other types of alignment features are contemplated, such as slot and groove attachment, press-fit features, ball detents, etc. Each of the alignment bores 192 can be sized to receive a fastener 194, which can be a screw, bolt, or other suitable fastener for securing the left, central, and right members 186, 188, 190 to each other. In operation, the central member 188 overlaps part of left member 186 and part of the right member 190, such that at least one of the alignment bores 192 of the central member 188 is aligned with at least one of the alignment bores 192 of the left member 186, and at least one of the alignment bores 192 of the central member 188 is aligned with at least one of the alignment bores 192 of the right member 190. The alignment of a set of the alignment bores 192 of the central member 188 with one of the alignment bores 192 of the left member 186 and one of the alignment bores 192 of the right member 190 allows the alignment bores 192 to receive a fastener 194 that secures the left, central, and right members 186, 188, 190 to each other such that the adjustable back 100 has a first width. The alignment of a set of the alignment bores 192 of the central member 188 with another one of the alignment bores 192 of the left member 186 and another one of the alignment bores 192 of the right member 190 allows the alignment bores 192 to receive a fastener 194 that secures the left, central, and right members 186, 188, 190 to each other such that the adjustable back 100 has a second width that is different than the first width. In the depicted embodiment, two fasteners 194 are shown securing the left and central members 186, 188 to each other and two fasteners 194 are shown securing the central and right members 188, 190 to each other. However, more or less fasteners 194 can be utilized to secure the left, central, and right members 186, 188, 190 to each other as desired.

Continuing with FIGS. 6-8, the left support bar 118 extends from the top support bar assembly 110 to the bottom support bar assembly 114, and is attached to the central support bar assembly 126 between the top and bottom support bar assemblies 110, 114. The left support bar 118 can define an outer surface 118*a* and an inner surface 118*b* opposite the outer surface 118*a* along the lateral direction 2, where the inner surface 118*b* faces the top, bottom, and central support bar assemblies 110, 114, 126. The left support bar 118 can also function as the attachment point for the left wing 106*b*, as will be discussed further below. The left support bar 118, like the other components of the lift chair frame, can define a plurality of elongate, oval gaps 132 that extend through the left support bar 118. In the depicted embodiment, the left support bar 118 defines four gaps 132, though more or less gaps are contemplated. The gaps 132 can allow the left support bar 118 to include less material, which decreases the overall weight and manufacturing cost associated with the left support bar 118. Additionally, the left support bar 118 can define a plurality of bores 136 that extend through the left support bar 118 and are configured to receive fasteners 234 for securing the left wing 106*b* to the left support bar 118, as will be discussed further below.

Opposite the left support bar 118, the right support bar 122 also extends from the top support bar assembly 110 to the bottom support bar assembly 114, and is attached to the central support bar assembly 126 between the top and bottom support bar assemblies 110, 114. The right support bar 122 can define an outer surface 122*a* and an inner surface 122*b* opposite the outer surface 122*a* along the lateral direction 2, where the inner surface 122*b* faces the top, bottom, and central support bar assemblies 110, 114, 126, as well as the inner surface 118*b* of the left support bar 118. The right support bar 122 can also function as the attachment point for the right wing 106*a*, as will be discussed further below. The right support bar 122, like the other components of the lift chair frame, can define a plurality of elongate, oval gaps 140 that extend through the right support bar 122. In the depicted embodiment, the right support bar 122 defines four gaps 140, though more or less gaps 140 are contemplated. The gaps 140 can allow the right support bar 122 to include less material, which decreases the overall weight and manufacturing cost associated with right support bar 122. Additionally, the right support bar 122 can define a plurality of bores that extend through the right support bar 122 and are configured to receive fasteners 216 for securing the right wing 106*a* to the right support bar 122, as will be discussed further below.

Like the adjustable seat 10, the adjustable back 100 can include a plurality of wires 198 that extend from the left support bar 118 to the right support bar 122. Each of the wires 198 can be spaced apart along the vertical direction 3, and can comprise a flexible metal that can deform under the weight of a cushion and a user resting against the cushion and adjustable back 100.

With continued reference to FIGS. 6-8, the right wing 106*a* can define a substantially bracket-shaped body the includes a top support bar 202, a bottom support bar 206 opposite the top support bar 202 along the vertical direction 3, and a right support bar 210 that extends between and connects the top and bottom support bars 202, 206. Though depicted as embodying a bracket shape, the right wing 106*a* can define other shapes as desired, such as rectangular, square, etc. The right wing 106*a* can also include a cover 214 disposed over and attached to at least the right support bar 210, though other designs for the cover 214 are contemplated. The cover 214 can be coupled to the right support bar 210 by fasteners 218, which can be screws, bolts, or other suitable fasteners for securing the cover 214 to the right support bar 210. The cover 214 can comprise a more pliable material than the back base 102, such as a polymer, though other materials are contemplated. The right wing 106*a* can be attached to the right support bar 122 of the back base 102 through a plurality of fasteners 216 that can engage the top and bottom support bars 202, 206. Like the fasteners 218, the fasteners 216 can be screws, bolts, or other suitable fasteners for securing the right wing 106*a* to the right support bar 122.

Similar to the right wing 106*a*, the left wing 106*b* can define a substantially bracket-shaped body the includes a top support bar 220, a bottom support bar 224 opposite the top support bar 220 along the vertical direction 3, and a left support bar 228 that extends between and connects the top and bottom support bars 220, 224. Though depicted as embodying a bracket shape, the left wing 106*b* can define other shapes as desired, such as rectangular, square, etc. The left wing 106*b* can also include a cover 232 disposed over and attached to at least the left support bar 228, though other designs for the cover 232 are contemplated. The cover 232 can be coupled to the left support bar 228 by fasteners 236, which can be screws, bolts, or other suitable fasteners for securing the cover 232 to the left support bar 228. The cover 232 can comprise a more pliable material than the back base 102, such as a polymer, though other materials are contemplated. The left wing 106*b* can be attached to the left support bar 118 of the back base 102 through a plurality of fasteners 234 that can engage the top and bottom support bars 220, 224. Like the fasteners 236, the fasteners 234 can be screws, bolts, or other suitable fasteners for securing the left wing 106*b* to the left support bar 118.

The upper wing 106*c*, like the right and left wings 106*a*, 106*b*, can define a substantially bracket-shaped body. However, the upper wing 106*c* is rotated 90 degrees relative to the right and left wings 106*a*, 106*b*, such that the cover 272 of the upper wing 106*c* can be normal to the vertical direction 3. The upper wing 106*c* includes a left support bar 240, a right support bar 244 opposite the left support bar 240 along the lateral direction 2, and a top support member 248 that extends from the left support bar 240 to the right support bar 244. In some embodiments the left support bar 240 can connect to the left wing 106*b*, and the left support bar 118 of the back base 102 in other embodiments. Likewise, the right support bar 244 can connect to the right wing 106*a* in some embodiments and to the right support bar 122 in other embodiments. To accommodate these differences, the upper wing 106*c* can comprise multiple components that are adjustable relative to each other, so as to adjust the overall width of the upper wing 106*c*.

As depicted, the top support member 248 includes a left member 252, a right member 260 opposite the left member 252 along the lateral direction 2, and a central member 256 that overlaps and connects the left and right members 252, 260. Each of the left, central, and right members 252, 256, 260 of the top support member 248 can include a plurality of alignment bores 264 sized to receive an adjustment fastener 268, which can be a screw, bolt, or other suitable fastener. In operation, the interaction between the alignment bores 264 and the adjustment fasteners 268 can be utilized to adjust the width of the upper wing 106*c*. In one embodiment, the left, central, and right members 252, 256, 260 can be positioned such that the alignment bores 264 of the left and right members 252, 260 are aligned with the alignment bores 264 of the central member 256 in a first configuration. In the first configuration, the adjustment fasteners 268 extend through the alignment bores 264 of the left, central, and right members 252, 256, 260 such that the left, central, and right members 252, 256, 260 are connected to define a width that allows the left member 252 to attach to the left support bar 118 of the back base 102 and the right member 260 to attach to the right support bar 122 of the back base 102. In another embodiment, the left, central, and right members 252, 256, 260 can be positioned such that the alignment bores 264 of the left and right members 252, 260 are aligned with the alignment bores 264 of the central member 256 in a second configuration. In the second configuration, the adjustment fasteners 268 extend through the alignment bores 264 of the left, central, and right members 252, 256, 260 such that the left, central, and right members 252, 256, 260 are connected to define a width that allows the left member 252 to attach to the left wing 106*b* and the right member 260 to attach to the right wing 106*a*.

The upper wing 106*c* can also include a cover 272 disposed over and attached to the left support bar 240, right support bar 244, and top support member 248. The cover 272 can be coupled to each of the left support bar 240, right support bar 244, and top support member 248 by fasteners 276, which can be screws, bolts, or other suitable fasteners. However, it is contemplated that the cover 272 can be coupled to any combination of the left support bar 240, right support bar 244, and top support member 248 as desired. The cover 232 can comprise a more pliable material than the back base 102, such as a polymer, though other materials are contemplated.

Referring to FIG. 8, the right wing 106*a*, left wing 106*b*, and upper wing 106*c* can be releasably attached to the back base 102 so as to adjust the height and width of the adjustable back 100. In one embodiment, none of the right, left, and upper wings 106*a*-106*c* is attached to the back base 102. In this configuration, the back base 102 defines a first width $W_4$ measured from the left support bar 118 to the right support bar 122 along the lateral direction 2, as well as a first height $H_1$ measured from the top support bar assembly 110 to the bottom support bar assembly 114 along the vertical direction 3. In another embodiment, only the upper wing 106*c* is attached to the back base 102. In this configuration, the adjustable back 100 defines the first width $W_4$, as well as a second height $H_2$ measured from the top support member 248 of the upper wing 104*c* to the bottom support bar assembly 114 of the back base 102 along the vertical direction 3. In a further embodiment, each of the right, left, and upper wings 106*a*-106*c* are attached to the back base 102. In this configuration, the adjustable back 100 defines a second width $W_5$ measured from the left support bar 240 of the left wing 106*b* to the right support bar 244 of the right wing 106*a* along the lateral direction 2, as well as the second height $H_2$. Each of the adjustments to the adjustable back 100 can be made separately from or in conjunction with the adjustments described above in relation to the adjustable seat 10.

Like the adjustable seat 10, it is contemplated that the adjustable back 100 can be configured such that the top support bar assembly 110, bottom support bar assembly 114, right support bar 122, and/or left support bar 118 can receive one or more hooks or other similar feature attached directly to the material for disposing a material over the adjustable seat 10, where the material can be a padding, fabric, etc. Although specific portions of the adjustable back 100 are mentioned, it is contemplated that any portion of the adjustable back 100 can receive such a hook. Though the hooks may be comprised of plastic, any conventional hook may be utilized.

Figure 9:
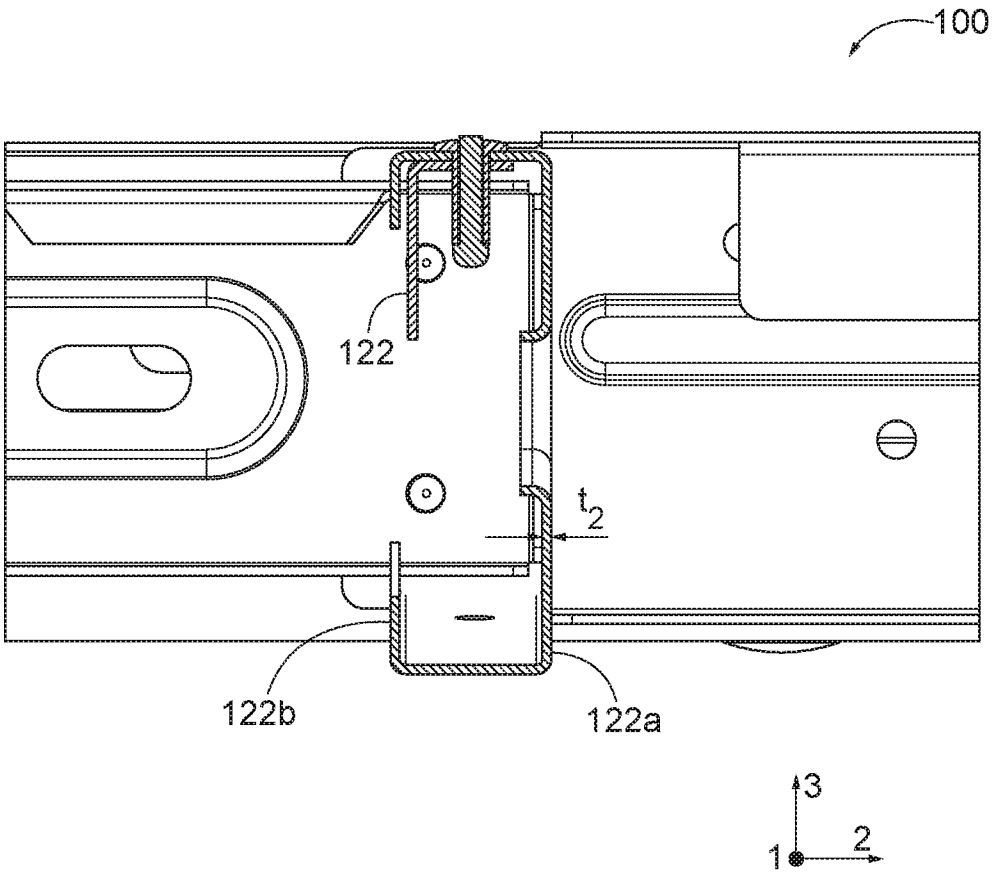
FIG. 9 is a cross-sectional view of the adjustable back as shown in FIG. 6, taken along line 9-9 shown in FIG. 8.
Figure 10:
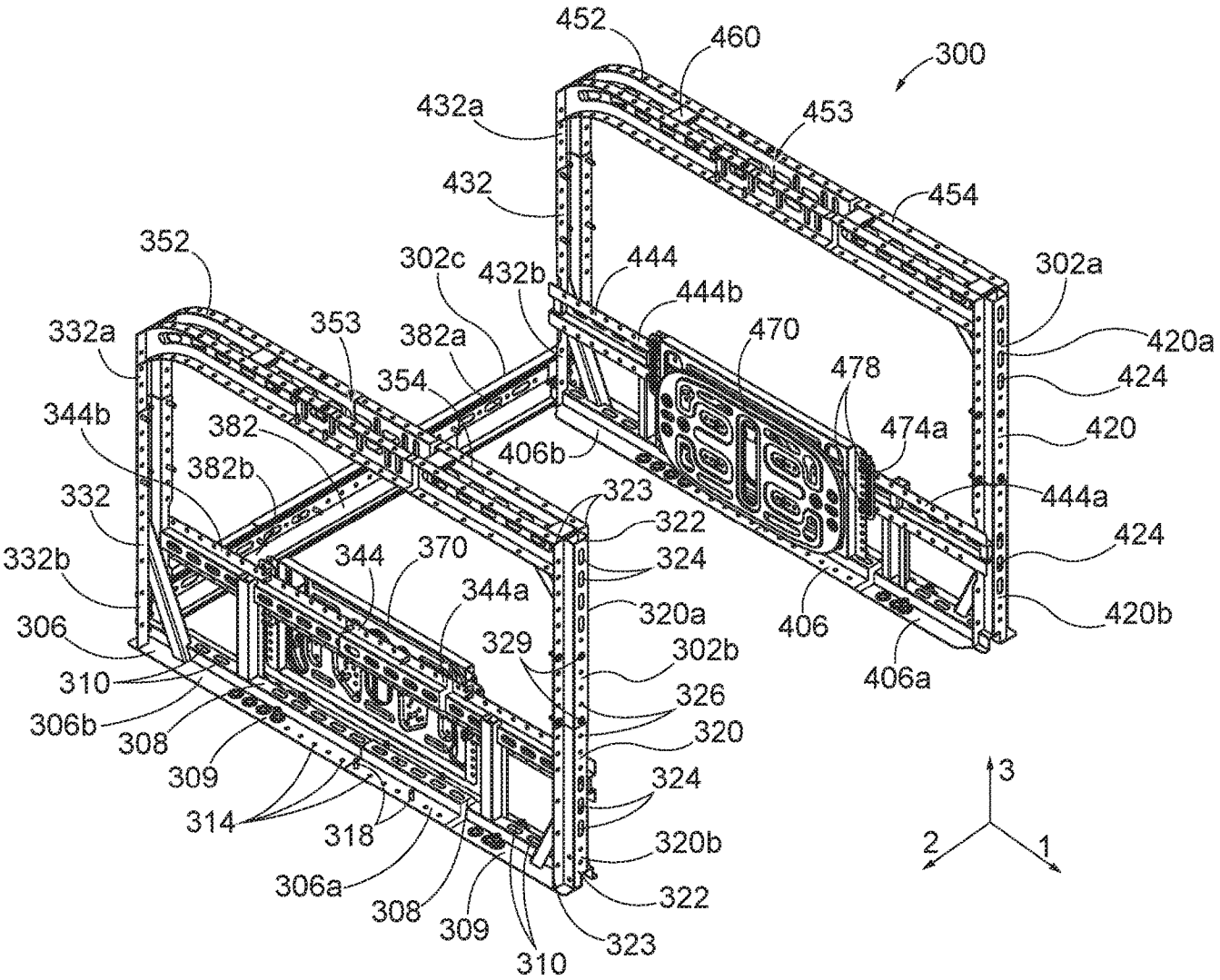
FIG. 10 is a perspective view of an adjustable chair shell of the lift chair frame according to an embodiment of the present disclosure.
Figure 11:
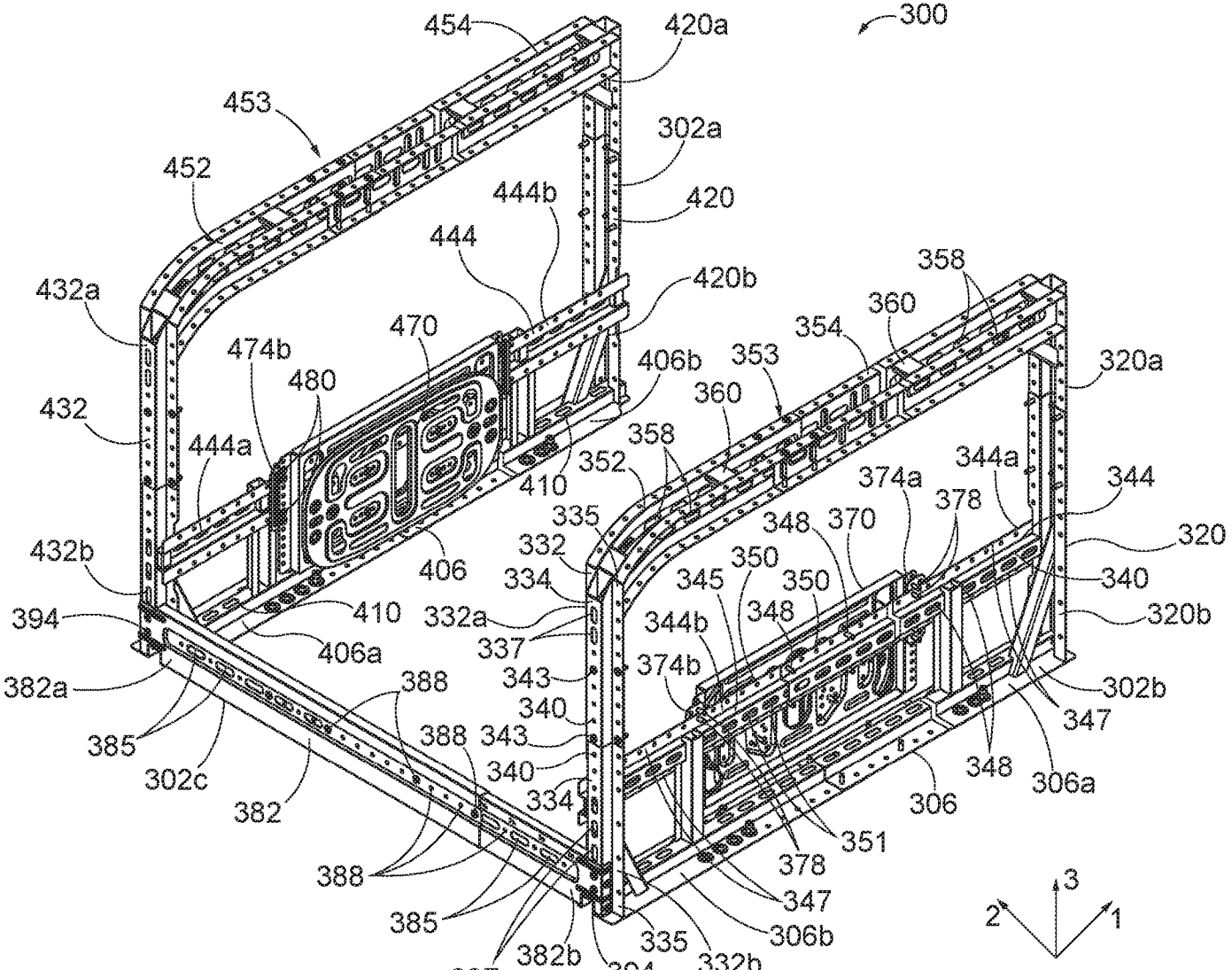
FIG. 11 is an another perspective view of the adjustable chair shell shown in FIG. 10.
Figure 12:
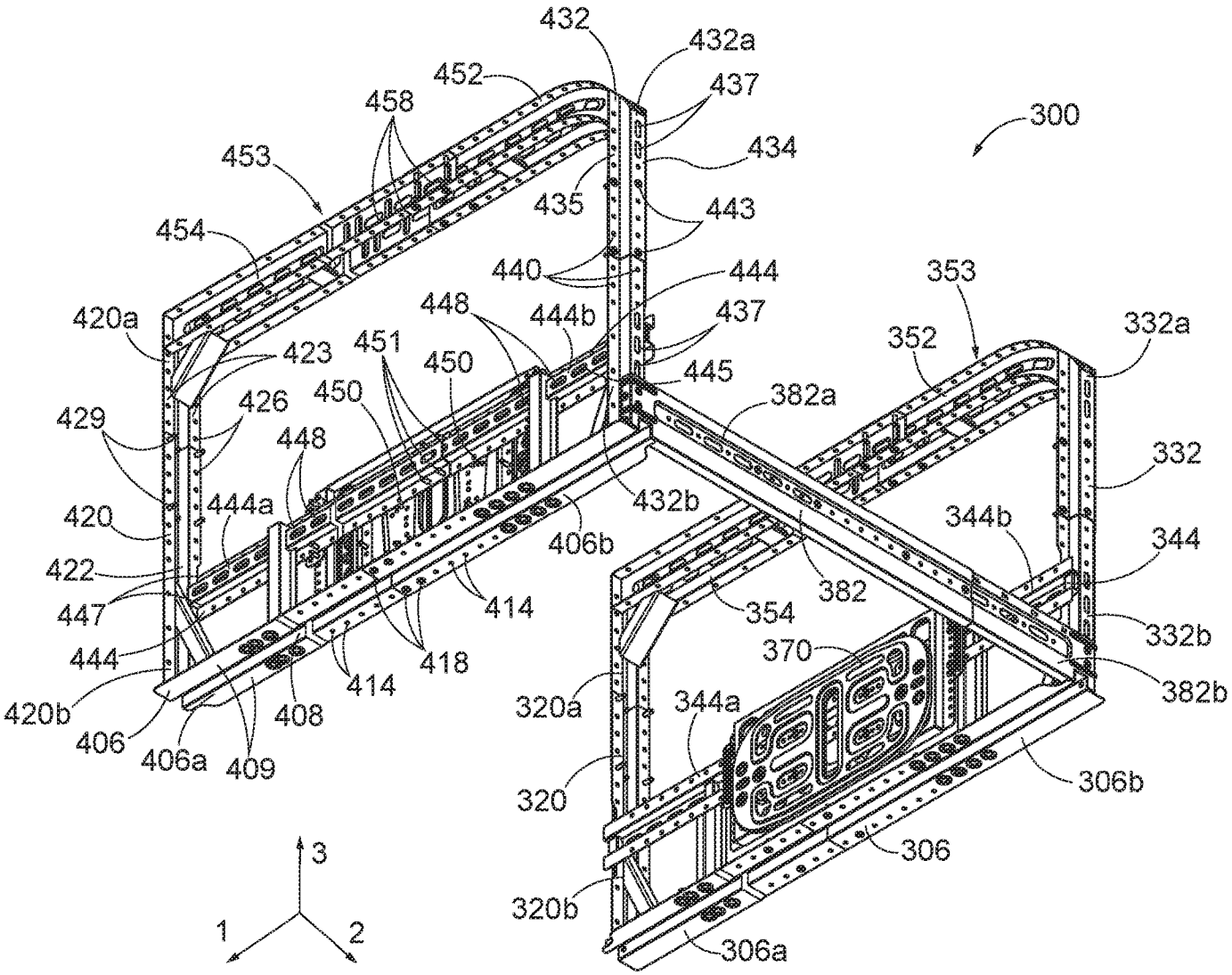
FIG. 12 is a further perspective view of the adjustable chair shell shown in FIG. 10.

Referring to FIG. 9, a cross-sectional view of the right support bar 122 of the adjustable back 100 is shown in cross section. As shown, the right support bar 122 can define a thickness $t_2$ that extends the lateral direction 2. The thickness $t_2$ can be from about 0.8 mm to about 1.2 mm. For example, in one embodiment the thickness $t_2$ is about 0.8 mm. In another embodiment, the thickness $t_2$ can be about 1.2 mm. Though the thickness of the right support bar 122 is explicitly shown, each of the other portions of the adjustable back 100 can define a similar thickness $t_2$. Also, each element of the adjustable back 100 can be comprised of a stamped and/or bent sheet metal. For example, each component of the adjustable back 100 can be comprised of steel. Different metals and thicknesses can be utilized in adjustable back 100, so long as the moment of inertia provides sufficient bending strength.

Now referring to FIGS. 10-15, the adjustable chair shell 300 of the lift chair frame will be described. The adjustable chair shell 300 comprises left portion 302*a*, a right portion 302*b* opposite the left portion 302*a* along the lateral direction 2, and a central portion 302*c* that connects the left portion 302*a* to the right portion 302*b*. The adjustable chair shell 300 and its component parts can adjusted so as to adjust the width, height, and length of the adjustable chair shell 300, as will be described below. The right portion 302*b* of the adjustable chair shell 300 can include a base assembly 306, a front support assembly 320 that is connected to and extends vertically from the front of the base assembly 306, a rear support assembly 332 opposite the front support assembly 320 along the longitudinal direction 1, where the rear support assembly 332 is connected to and extends vertically from the rear of the base assembly 306, and an arm assembly 353 opposite the base assembly 306 along the vertical direction 3, where the arm assembly 353 extends between and is connected to the front support assembly 320 and rear support assembly 332. The right portion 302*b* can also include a central support assembly 344 that extends from the front support assembly 320 to the rear support assembly 332 vertically between the arm assembly 353 and the base assembly 306.

The base assembly 306 of the right portion 302*b* can comprise multiple members that are releasably coupled to each other. As depicted, the base assembly 306 comprises a front member 306*a* connected to the front support assembly 320 and a rear member 306*b* connected to the front member 306*a* and the rear support assembly 332. Each of the front and rear members 306*a*, 306*b* is depicted as defining a substantially U-shaped central rib 308, as well as extension 309 that extend from the lower end of both sides of the central rib 308. Though the base assembly 306 is depicted and described as having a particular shape, this disclosure is not meant to be limited to such. The rib 308 of each of the front and rear members 306*a*, 306*b* can include a plurality of gaps 310 that extend through their respective bodies. For example, the central rib 308 of each of the front and rear members 306*a*, 306*b* of the base assembly 306 can include at least seven elongate, substantially oval gaps 310. Alternatively or in addition, the gaps 310 can be defined through the extensions 309 of the front and rear members 306*a*, 306*b*. However, more or less gaps 310 are contemplated, as well as gaps 310 having different shapes and sizes. Like the other gaps described herein, the gaps 310 allow the base assembly 306 to include less material, thus decreasing the overall weight and manufacturing cost associated with the right portion 302*b*.

Figure 13A:
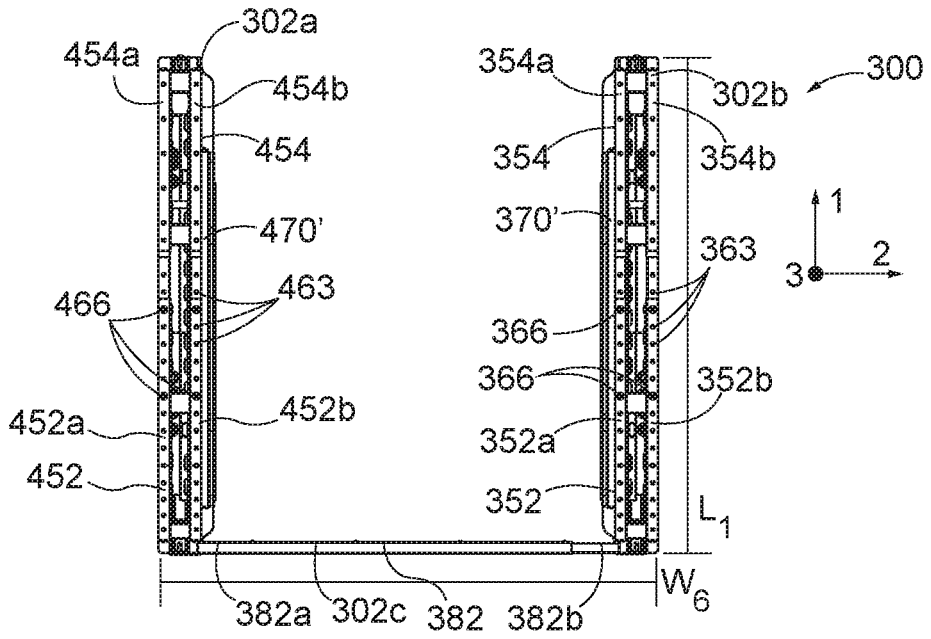
FIG. 13A is a top view of the adjustable chair shell shown in FIG. 10 adjusted to a first configuration.
Figure 14A:
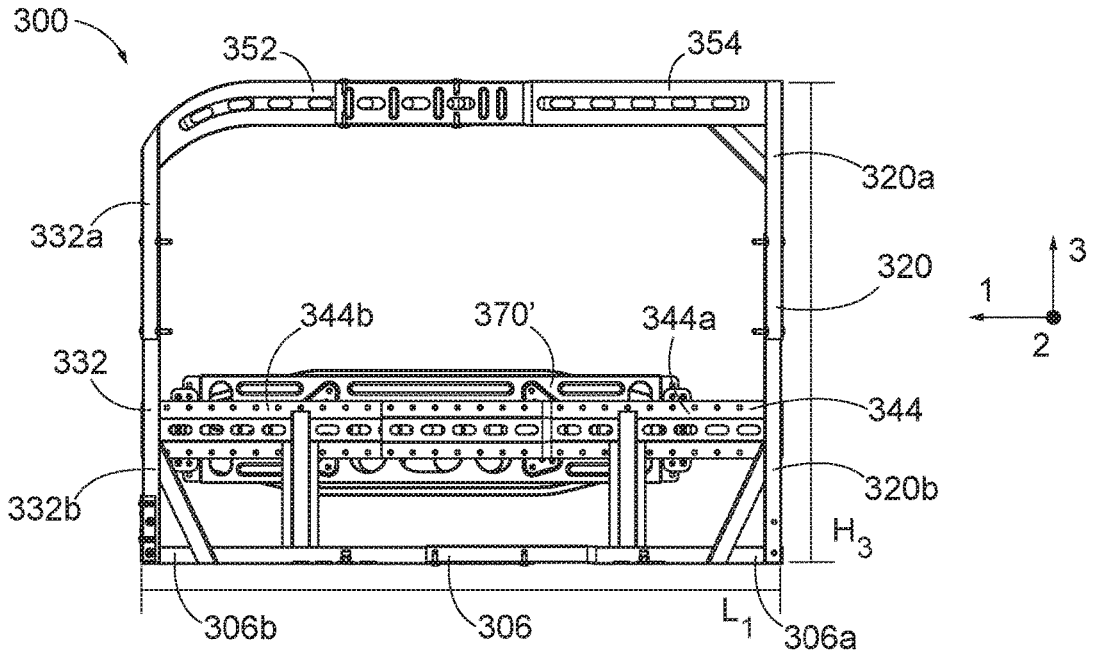
FIG. 14A is a side view of the adjustable chair shell shown in FIG. 10 adjusted to a first configuration.
Figure 14B:
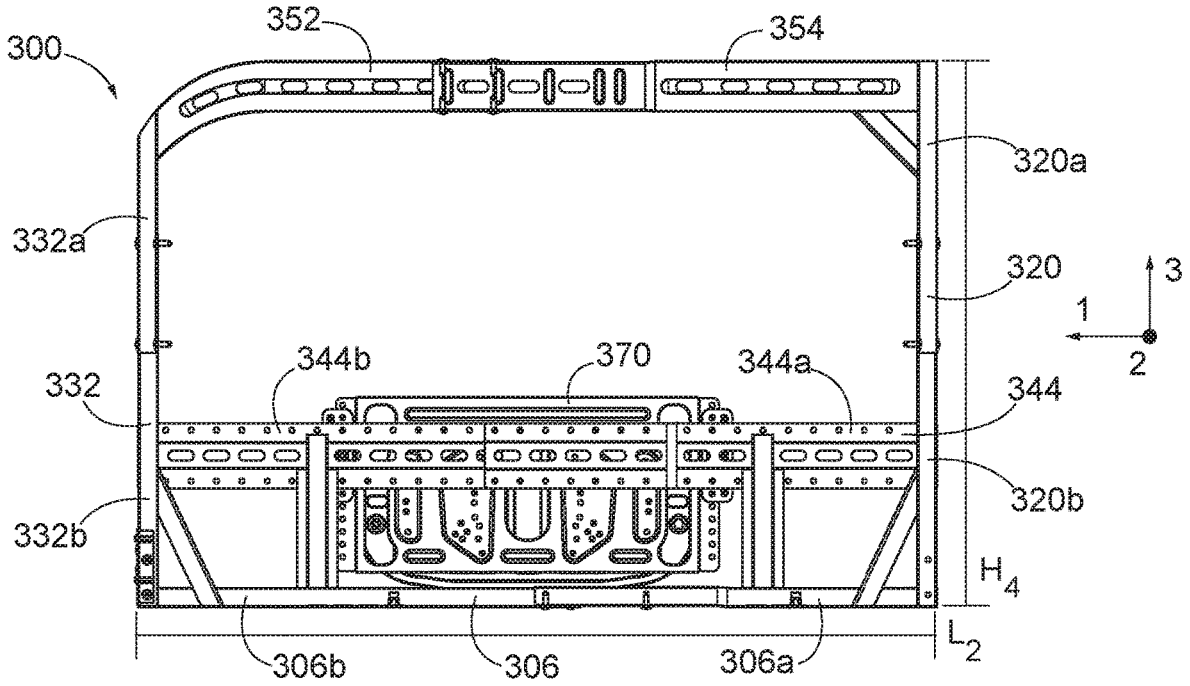
FIG. 14B is a side view of the adjustable chair shell shown in FIG. 10 adjusted to a second configuration.

Each of the front and rear members 306*a*, 306*b* includes a plurality of alignment features positioned in predetermined locations that correspond to predetermined lengths of the adjustable chair shell 300. In the depicted embodiment, the alignment features are a plurality of alignment bores 314 that extend completely through the respective front and rear members 306*a*, 306*b*. However, other types of alignment features are contemplated, such as slot and groove attachment, press-fit features, ball detents, etc. In particular, the alignment bores 314 are depicted as extending completely through the extensions 309 of the front and rear members 306*a*, 306*b*, though it is contemplated that the alignment bores 314 can also be defined by the central rib 308. Each of the alignment bores 314 can be sized to receive an adjustment fastener 318, which can be a screw, bolt, or other suitable fastener. In operation, securing the front and rear members 306*a*, 306*b* to each other during assembly by inserting adjustment fasteners 318 through predetermined combinations of the alignment bores 314 can be utilized to adjust the length of the adjustable chair shell 300. In this regard, the front and rear members 306*a*, 306*b* can be positioned relative to each other such that one of the alignment bores 314 of the front member 306*a* is aligned with one of the alignment bores 314 of the rear member 306*b* in a first configuration. When the front and rear members 306*a*, 306*b* are in the first configuration, inserting the adjustment fasteners 318 through a first set of the alignment bores 314 of the front and rear members 306*a*, 306*b* can secure the front and rear members 306*a*, 306*b* to each other such that the right portion 302*b* of the adjustable chair shell 300 defines a first length $L_1$ (FIGS. 13A and 14A).

Alternatively, the front and rear members 306*a*, 306*b* can be positioned such that one of the alignment bores 314 of the front member 306*a* is aligned with another one of the alignment bores 314 of the rear member 306*b* in a second configuration. When the front and rear members 306*a*, 306*b* are in the second configuration, inserting the adjustment fasteners 318 through a second set of the alignment bores 314 of the front and rear members 306*a*, 306*b* can secure the front and rear members 306*a*, 306*b* to each other such that the right portion 302*b* of the adjustable chair shell 300 defines a second length $L_2$. This process can be similarly performed for any other number of configurations so that the adjustable chair shell 300 defines any other number of lengths. Further, when the adjustable chair shell is in either of the first or second configurations, any number of adjustment fasteners 318 can be inserted through the alignment bores 314 to secure the front and rear members 306*a*, 306*b* to each other. In the depicted embodiment, four adjustment fasteners 318 are used (two on each side of the central rib 308).

Continuing with FIGS. 10-15, the front support assembly 320 of the right portion 302*b* can comprise multiple members coupled to each other. As depicted, the front support assembly 320 comprises an upper member 320*a* connected to the arm assembly 353 and a lower member 320*b* connected to the upper member 320*a* and the base assembly 306. Each of the upper and lower members 320*a*, 320*b* is depicted as defining a substantially U-shaped central rib 322, as well as extension 323 that extend from the inner end of both sides of the central rib 322. Though the front support assembly 320 is depicted and described as having a particular shape, this disclosure is not meant to be limited to such. The rib 322 of each of the upper and lower members 320*a*, 320*b* can include a plurality of gaps 324 that extend through their respective bodies. For example, the central rib 322 of each of the upper and lower members 320*a*, 320*b* of the front support assembly 320 can include at least three elongate, substantially oval gaps 324. Alternatively or in addition, the gaps 324 can be defined through the extensions 323 of the upper and lower members 320*a*, 320*b*. However, more or less gaps 324 are contemplated, as well as gaps 324 having different shapes and sizes. Like the other gaps described herein, the gaps 324 allow the front support assembly 320 to include less material, thus decreasing the overall weight and manufacturing cost associated with the right portion 302*b*.

Each of the upper and lower members 320*a*, 320*b* includes a plurality of alignment features positioned in predetermined locations that correspond to predetermined heights of the right portion 302*b* of the adjustable chair shell 300. In the depicted embodiment, the alignment features are a plurality of alignment bores 326 that extend completely through the respective upper and lower members 320*a*, 320*b*. However, other types of alignment features are contemplated, such as slot and groove attachment, press-fit features, ball detents, etc. In particular, the alignment bores 326 are depicted as extending completely through the extensions 323 as well as the central rib 322 of the upper and lower members 320*a*, 320*b*. Each of the alignment bores 326 can be sized to receive an adjustment fastener 329, which can be a screw, bolt, or other suitable fastener. In operation, securing the upper and lower members 320*a*, 320*b* to each other during assembly by inserting the adjustment fasteners 329 through predetermined combinations of the alignment bores 326 can be utilized to adjust the height of the right portion 302*b* of the adjustable chair shell 300. In one configuration, the upper and lower members 320*a*, 320*b* can be positioned such that one of the alignment bores 326 of the upper member 320*a* is aligned with one of the alignment bores 326 of the lower member 320*b* in a first configuration. When the upper and lower members 320*a*, 320*b* are in the first configuration, inserting the adjustment fasteners 329 through a first set of the bores 326 of the upper and lower members 320*a*, 320*b* can secure the upper and lower members 320*a*, 320*b* to each other such that the adjustable chair shell 300 defines a first height H4 (FIG. 14A).

Alternatively, the upper and lower members 320*a*, 320*b* can be positioned such that one of the alignment bores 326 of the upper member 320*a* is aligned with another one of the alignment bores 326 of the lower member 320*b* in a second configuration. When the upper and lower members 320*a*, 320*b* are in the second configuration, inserting the adjustment fasteners 329 through a second set of the alignment bores 326 of the upper and lower members 320*a*, 320*b* can secure the upper and lower members 320*a*, 320*b* to each other such that the right portion 302*b* of the adjustable chair shell 300 defines a second height $H_5$. This process can be similarly performed for any other number of configurations so that the adjustable chair shell 300 defines any other number of heights. Further, when the front support assembly 320 is in either of the first or second configurations, any number of adjustment fasteners 329 can be inserted through the alignment bores 326 to secure the upper and lower members 320*a*, 320*b* to each other. In the depicted embodiment, six adjustment fasteners 329 are used (two in the central rib 322, and two in each extension 323 on both sides of the central rib 322).

Opposite the front support assembly 320, the rear support assembly 332 of the right portion 302*b* can comprise multiple members that are releasably coupled to each other. As depicted, the rear support assembly 332 comprises an upper member 332*a* connected to the arm assembly 353 and a lower member 332*b* connected to the upper member 332*a* and the base assembly 306. Each of the upper and lower members 332*a*, 332*b* is depicted as defining a substantially U-shaped central rib 334, as well as extension 335 that extend from the inner end of both sides of the central rib 334. Though the rear support assembly 332 is depicted and described as having a particular shape, this disclosure is not meant to be limited to such. The rib 334 of each of the upper and lower members 332*a*, 332*b* can include a plurality of gaps 337 that extend through their respective bodies. For example, the central rib 334 of each of the upper and lower members 332*a*, 332*b* of the rear support assembly 332 can include at least two elongate, substantially oval gaps 337. Alternatively or in addition, the gaps 337 can be defined through the extensions 335 of the upper and lower members 332*a*, 332*b*. However, more or less gaps 337 are contemplated, as well as gaps 337 having different shapes and sizes. Like the other gaps described herein, the gaps 337 allow the rear support assembly 332 to include less material, thus decreasing the overall weight and manufacturing cost associated with the right portion 302*b*.

Each of the upper and lower members 332*a*, 332*b* includes a plurality of alignment features positioned in predetermined locations that correspond to predetermined widths of the right portion 302*b* of the adjustable chair shell 300. In the depicted embodiment, the alignment features are a plurality of alignment bores 340 that extend completely through the respective upper and lower members 332*a*, 332*b*. However, other types of alignment features are contemplated, such as slot and groove attachment, press-fit features, ball detents, etc. In particular, the alignment bores 340 are depicted as extending completely through the extensions 335 as well as the central rib 334 of the upper and lower members 332*a*, 332*b*. Each of the alignment bores 340 can be sized to receive an adjustment fastener 343, which can be a screw, bolt, or other suitable fastener. In operation, securing the upper and lower members 332*a*, 332*b* to each other during assembly by inserting the adjustment fasteners 343 through predetermined combinations of the alignment bores 340 can be utilized to adjust the height of the right portion 302*b* of the adjustable chair shell 300. In one configuration, the upper and lower members 332*a*, 332*b* can be positioned such that one of the alignment bores 340 of the upper member 332*a* is aligned with one of the alignment bores 340 of the lower member 332*b* in a first configuration. When the upper and lower members 332*a*, 332*b* are in the first configuration, inserting the adjustment fasteners 343 through the a first set of the bores 340 of the upper and lower members 332*a*, 332*b* can secure the upper and lower members 332*a*, 332*b* to each other such that the adjustable chair shell 300 defines a first height H4 (FIG. 14A).

Alternatively, the upper and lower members 332*a*, 332*b* can be positioned such that one of the alignment bores 340 of the upper member 332*a* is aligned with another one of the alignment bores 340 of the lower member 332*b* in a second configuration. When the upper and lower members 332*a*, 332*b* are in the second configuration, inserting the adjustment fasteners 343 through a second set of the alignment bores 340 of the upper and lower members 332*a*, 332*b* can secure the upper and lower members 332*a*, 332*b* to each other such that the adjustable chair shell 300 defines a second height $H_5$. This process can be similarly performed for any other number of configurations so that the adjustable chair shell 300 defines any other number of heights. Further, when the rear support assembly 332 is in either of the first or second configurations, any number of adjustment fasteners 343 can be inserted through the alignment bores 340 to secure upper and lower members 332*a*, 332*b* to each other. In the depicted embodiment, six adjustment fasteners 343 are used (two in the central rib 334, and two in each extension 335 on both sides of the central rib 334).

Continuing with FIGS. 10-15, opposite the base assembly 306 of the right portion 302*b*, the arm assembly 353 can comprise multiple members that are releasably coupled to each other. As depicted, the arm assembly 353 comprises a front arm 354 connected to the front support assembly 320 and a rear arm 352 connected to the front arm 354 and the rear support assembly 332. Each of the front and rear arms 354, 352 is depicted as including two separate, I-shaped portions spaced apart along the lateral direction 2. The front arm 354 includes a left member 354*a* and a right member 354*b* spaced from the left member 354*a* along the lateral direction 2, while the rear arm 352 includes a left member 352*a* and a right member 352*b* spaced from the left member 352*a* along the lateral direction 2. The left and right members 354*a*, 354*b* of the front arm 354 and the left and right members 352*a*, 352*b* of the rear arm 352 can be connected by connectors 360 that extend along the lateral direction 2 and are spaced apart along the longitudinal direction 1 to provide added stability to the arm assembly 353. Alternatively, the use of stabilizing means other than the connectors 360 is contemplated. The left member 354*a* of the front arm 354 is attached to the left member 352*a* of the rear arm 352, while the right member 354*b* of the front arm 354 is attached to the right member 352*b* of the rear arm 352. Though each of the left and right members 354*a*, 354*b*, 352*a*, 352*b* of the front and rear arms 354, 352 is depicted and described as having a particular shape, this disclosure is not meant to be limited to such. Each of the left and right members 354*a*, 354*b*, 352*a*, 352*b* of the front and rear arms 354, 352 can include a plurality of gaps 358 that extend laterally through their respective bodies. For example, each of the left and right members 354*a*, 354*b*, 352*a*, 352*b* of the arm assembly 353 can include at least six elongate, substantially oval gaps 358. However, more or less gaps 358 are contemplated, as well as gaps 358 having different shapes and sizes. Like the other gaps described herein, the gaps 358 allow the arm assembly 353 to include less material, thus decreasing the overall weight and manufacturing cost associated with the right portion 302*b*.

Each of the left and right members 354*a*, 354*b*, 352*a*, 352*b* of the front and rear arms 354, 352 includes a plurality of alignment features positioned in predetermined locations that correspond to predetermined lengths of the right portion 302*b* of the adjustable chair shell 300. In the depicted embodiment, the alignment features are alignment bores 363 that extend completely through the top and bottom portions of the left and right members 354*a*, 354*b*, 352*a*, 352*b*. However, other types of alignment features are contemplated, such as slot and groove attachment, press-fit features, ball detents, etc. Each of the alignment bores 363 can be sized to receive an adjustment fastener 366, which can be a screw, bolt, or other suitable fastener. In operation, securing the left and right members 354*a*, 354*b*, 352*a*, 352*b* to each other during assembly by inserting the adjustment fasteners 366 through predetermined combinations of the alignment bores 363 can be utilized to adjust the length of the right portion 302*b* of the adjustable chair shell 300. In one configuration, the front and rear arms 354, 352 can be positioned such that one of the alignment bores 363 of the left member 354*a* is aligned with one of the alignment bores 363 of the left member 352*a* and one of the alignment bores 363 of the right member 354*b* is aligned with one of the alignment bores 363 of the right member 352*b* in a first configuration. When the front and rear arms 354, 352 are in the first configuration, inserting the adjustment fasteners 366 through a first set of the alignment bores 363 of the front and rear arms 354, 352 can secure the front and rear arms 354, 352 to each other such that the right portion 302*b* of the adjustable chair shell 300 defines a first length $L_1$ (FIGS. 13A and 14A).

Alternatively, the front and rear arms 354, 352 can be positioned such that one of the alignment bores 363 of the left member 354*a* is aligned with another one of the alignment bores 363 of the left member 352*a* and one of the alignment bores 363 of the right member 354*b* is aligned with another one of the alignment bores 363 of the right member 352*b* in a second configuration. When the front and rear arms 354, 352 are in the second configuration, inserting the adjustment fasteners 366 through the a second set of the alignment bores 363 of the front and rear arms 354, 352 can secure the front and rear arms 354, 352 to each other such that the right portion 302*b* of the adjustable chair shell 300 defines a second length $L_2$. This process can be similarly performed for any other number of configurations so that the adjustable chair shell 300 defines any other number of lengths. In the depicted embodiment, eight fasteners 366 are used to secure the front and rear arms 352, 354 to each other. However, any number of adjustment fasteners 366 can be inserted through the alignment bores 363 to secure the front and rear arms 354, 352 to each other.

Between the arm assembly 353 and the base assembly 306, the central support assembly 344 of the right portion 302*b* extends from the front support assembly 320 to the rear support assembly 332. The central support assembly 344, like the other components of the right portion 302*b*, can comprise multiple members that are releasably coupled to each other. As depicted, the central support assembly 344 comprises a front member 344*a* connected to the front support assembly 320 and a rear member 344*b* connected to the front member 344*a* and the rear support assembly 332. Each of the front and rear members 344*a*, 344*b* is depicted as defining a substantially U-shaped central rib 345, as well as extension 347 that extend from the lower end of both sides of the central rib 345. Though the central support assembly 344 is depicted and described as having a particular shape, this disclosure is not meant to be limited to such. The rib 345 of each of the front and rear members 344*a*, 344*b* can include a plurality of gaps 348 that extend through their respective bodies. For example, the central rib 345 of each of the front and rear members 344*a*, 344*b* of the central support assembly 344 can include at least eight elongate, substantially oval gaps 348. Alternatively or in addition, the gaps 348 can be defined through the extensions 347 of the front and rear members 344*a*, 344*b*. However, more or less gaps 348 are contemplated, as well as gaps 348 having different shapes and sizes. Like the other gaps described herein, the gaps 348 allow the central support assembly 344 to include less material, thus decreasing the overall weight and manufacturing cost associated with the right portion 302*b*.

Each of the front and rear members 344*a*, 344*b* of the central support assembly 344 includes a plurality of alignment features positioned in predetermined locations that correspond to predetermined lengths of the right portion 302*b* of the adjustable chair shell 300. In the depicted embodiment, the alignment features are a plurality of alignment bores 350 that extend completely through the respective front and rear members 344*a*, 344*b*. However, other types of alignment features are contemplated, such as slot and groove attachment, press-fit features, ball detents, etc. In particular, the alignment bores 350 are depicted as extending completely through the extensions 347 of the front and rear members 344*a*, 344*b*, though it is contemplated that the alignment bores 350 can also be defined by the central rib 345. Each of the alignment bores 350 can be sized to receive an adjustment fastener 351, which can be a screw, bolt, or other suitable fastener. In operation, securing the front and rear members 344*a*, 344*b* to each other during assembly by inserting the adjustment fasteners 351 through predetermined combinations of the alignment bores 350 can be utilized to adjust the length of the right portion 302*b* of the adjustable chair shell 300. In one configuration, the front and rear members 344*a*, 344*b* can be positioned such that one of the alignment bores 350 of the front member 344*a* is aligned with one of the alignment bores 350 of the rear member 344*b* in a first configuration. When the front and rear members 344*a*, 344*b* are in the first configuration, inserting the adjustment fasteners 351 through a first set of the bores 350 of the front and rear members 344*a*, 344*b* can secure the front and rear members 344*a*, 344*b* to each other such that the right portion 302*b* of the adjustable chair shell 300 defines a first length $L_1$ (FIGS. 13A and 14A).

Alternatively, the front and rear members 344*a*, 344*b* can be positioned such that one of the alignment bores 350 of the front member 344*a* is aligned with another one of the alignment bores 350 of the rear member 344*b* in a second configuration. When the front and rear members 344*a*, 344*b* are in the second configuration, inserting the adjustment fasteners 351 through a second set of the alignment bores 350 of the front and rear members 344*a*, 344*b* can secure the front and rear members 344*a*, 344*b* to each other such that the right portion 302*b* of the adjustable chair shell 300 defines a second length $L_2$. This process can be similarly performed for any other number of configurations so that the adjustable chair shell 300 defines any other number of lengths. Further, when the adjustable chair shell 300 is in either of the first or second configurations, any number of adjustment fasteners 351 can be inserted through the alignment bores 350 to secure the front and rear members 344*a*, 344*b* to each other. In the depicted embodiment, four adjustment fasteners 351 are used (two on each side of the central rib 345).

The right portion 302*b* of the adjustable chair shell 300 can further include a support 370 attached to the inner side of the right portion 302*b*. The right portion 302*b* can include connecting bars 374*a*, 374*b* that can be positioned at the outer side of each longitudinal end of the support 370 to connect the support 370 to the central support assembly 344.

Specifically, the connecting bar 374*a* can be positioned between the support 370 and the front member 344*a* of the central support assembly 344, while the connecting bar 374*b* can be positioned between the support 370 and the rear member 344*b* of the central support assembly 344. Fasteners 378 can be utilized to attach the support 370 to the central support assembly 344 via the connecting bars 374*a*, 374*b*, though other methods of attachment are also contemplated. The support 370 can be utilized to attach the adjustable chair shell 300 to other portions of the lift chair, such as the lift mechanism (not shown) or the adjustable seat 10. The support 370 can also have different embodiments, such as the support 370' shown in FIGS. 13A and 14A.

With continued reference to FIGS. 10-15, the central portion 302*c* of the adjustable chair shell 300 will be described. The central portion 302*c* functions to connect the left and right portions 302*a*, 302*b*, as well as adjust the width of the adjustable chair shell 300, as will be discussed further below. The central portion 302*c* can comprise multiple members that are releasably coupled to each other to adjust the width of the adjustable chair shell 300. As depicted, the central portion 302*c* comprises a left member 382*a* connected to the left portion 302*a* of the adjustable chair shell 300, particularly the rear support assembly 432, and a right member 382*b* connected to the right portion 302*b* of the adjustable chair shell 300, particularly the rear support assembly 332. The central portion 302*c* can be connected to the left and right portions 302*a*, 302*b* through the use of fasteners 394, which can be screws, bolts, etc. However, other methods of securing the central portion 302*c* to the left and right portions 302*a*, 302*b* are contemplated. Each of the left and right members 382*a*, 382*b* can include a plurality of gaps 385 that extend through their respective bodies. For example, each of the left and right members 382*a*, 382*b* of the central portion 302*c* can include at least three elongate, substantially oval gaps 385. However, more or less gaps 385 are contemplated, as well as gaps 385 having different shapes and sizes. Like the other gaps described herein, the gaps 385 allow the central portion 302*c* to include less material, thus decreasing the overall weight and manufacturing cost associated with the central portion 302*c*.

Each of the left and right members 382*a*, 382*b* includes a plurality of alignment features positioned in predetermined locations that correspond to predetermined widths of the adjustable chair shell 300. In the depicted embodiment, the alignment features are a plurality of alignment bores 388 that extend completely through the respective left and right members 382*a*, 382*b*. However, other types of alignment features are contemplated, such as slot and groove attachment, press-fit features, ball detents, etc. Each of the alignment bores 388 can be sized to receive an adjustment fastener 391, which can be a screw, bolt, or other suitable fastener. In operation, securing the left and right members 382*a*, 382*b* of the central portion 302*c* to each other during assembly by inserting the adjustment fasteners 391 through predetermined combinations of the alignment bores 388 can be utilized to adjust the width of the adjustable chair shell 300. In one configuration, the left and right members 382*a*, 382*b* can be positioned such that one of the alignment bores 388 of the left member 382*a* is aligned with one of the alignment bores 388 of the right member 382*b* in a first configuration. When the left and right members 382*a*, 382*b* are in the first configuration, inserting the adjustment fasteners 391 through a first set of the bores 388 of the left and right members 382*a*, 382*b* can secure the left and right members 382*a*, 382*b* to each other such that the central portion 302*c* of the adjustable chair shell 300 defines a first width W6 (FIG. 13A).

Figure 13B:
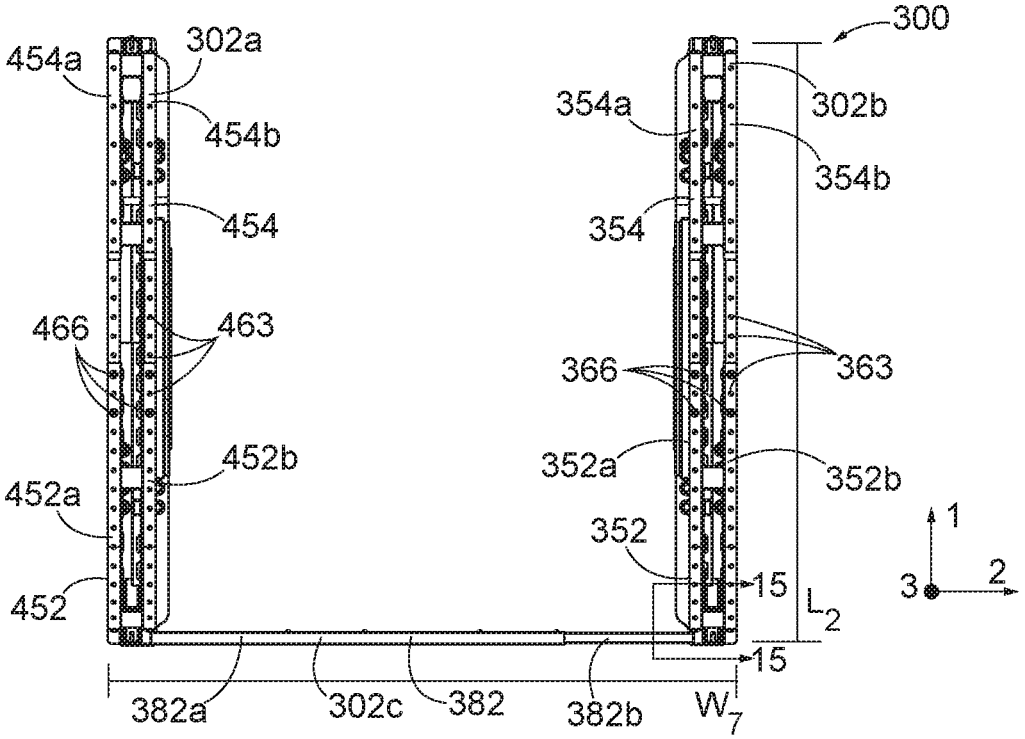
FIG. 13B is a top view of the adjustable chair shell shown in FIG. 10 adjusted to a second configuration.

Alternatively, the left and right members 382*a*, 382*b* can be positioned such that one of the alignment bores 388 of the left member 382*a* is aligned with another one of the alignment bores 388 of the right member 382*b* in a second configuration. When the left and right members 382*a*, 382*b* are in the second configuration, inserting the adjustment fasteners 391 through a second set of the alignment bores 388 of the left and right members 382*a*, 382*b* can secure the left and right members 382*a*, 382*b* to each other such that the central portion 302*c* of the adjustable chair shell 300 defines a second width W7 (FIG. 13B). This process can be similarly performed for any other number of configurations so that the adjustable chair shell 300 defines any other number of widths. Further, when the adjustable chair shell 300 is in either of the first or second configurations, any number of adjustment fasteners 391 can be inserted through the alignment bores 388 to secure the left and right members 382*a*, 382*b* to each other. In the depicted embodiment, four adjustment fasteners 391 are used.

Continuing with FIGS. 10-15, the left portion 302*a* of the adjustable chair shell 300 will be described. The left portion 302*a* can include a base assembly 406, a front support assembly 420 that is connected to and extends vertically from the front of the base assembly 406, a rear support assembly 432 opposite the front support assembly 420 along the longitudinal direction 1, where the rear support assembly 432 is connected to and extends vertically from the rear of the base assembly 406, and an arm assembly 453 opposite the base assembly 406 along the vertical direction 3, where the arm assembly 453 extends between and is connected to the front support assembly 420 and rear support assembly 432.

The base assembly 406 of the left portion 302*a* can comprise multiple members that are releasably coupled to each other. As depicted, the base assembly 406 comprises a front member 406*a* connected to the front support assembly 420 and a rear member 406*b* connected to the front member 406*a* and the rear support assembly 432. Each of the front and rear members 406*a*, 406*b* is depicted as defining a substantially U-shaped central rib 408, as well as extension 409 that extend from the lower end of both sides of the central rib 408. Though the base assembly 406 is depicted and described as having a particular shape, this disclosure is not meant to be limited to such. The rib 408 of each of the front and rear members 406*a*, 406*b* can include a plurality of gaps 410 that extend through their respective bodies. For example, the central rib 408 of each of the front and rear members 406*a*, 406*b* of the base assembly 406 can include at least seven elongate, substantially oval gaps 410. Alternatively or in addition, the gaps 410 can be defined through the extensions 409 of the front and rear members 406*a*, 406*b*. However, more or less gaps 410 are contemplated, as well as gaps 410 having different shapes and sizes. Like the other gaps described herein, the gaps 410 allow the base assembly 406 to include less material, thus decreasing the overall weight and manufacturing cost associated with the left portion 302*a*.

Each of the front and rear members 406*a*, 406*b* includes a plurality of alignment features positioned in predetermined locations that correspond to predetermined lengths of the left portion 302*a* of the adjustable chair shell 300. In the depicted embodiment, the alignment features are a plurality of alignment bores 414 that extend completely through the respective front and rear members 406*a*, 406*b*. However, other types of alignment features are contemplated, such as slot and groove attachment, press-fit features, ball detents, etc. In particular, the alignment bores 414 are depicted as extending completely through the extensions 409 of the front and rear members 406*a*, 406*b*, though it is contemplated that the alignment bores 414 can also be defined by the central rib 408. Each of the alignment bores 414 can be sized to receive an adjustment fastener 418, which can be a screw, bolt, or other suitable fastener. In operation, securing the front and rear members 406*a*, 406*b* to each other during assembly by inserting the adjustment fasteners 418 through predetermined combinations of the alignment bores 414 can be utilized to adjust the length of the left portion 302*a* of the adjustable chair shell 300. In one configuration, the front and rear members 406*a*, 406*b* can be positioned such that one of the alignment bores 414 of the front member 406*a* is aligned with one of the alignment bores 414 of the rear member 406*b* in a first configuration. When the front and rear members 406*a*, 406*b* are in the first configuration, inserting the adjustment fasteners 418 through a first set of the bores 414 of the front and rear members 406*a*, 406*b* can secure the front and rear members 406*a*, 406*b* to each other such that the left portion 302*a* of the adjustable chair shell 300 defines a first length $L_1$ (FIGS. 13A and 14A).

Alternatively, the front and rear members 406*a*, 406*b* can be positioned such that one of the alignment bores 414 of the front member 406*a* is aligned with another one of the alignment bores 414 of the rear member 406*b* in a second configuration. When the front and rear members 406*a*, 406*b* are in the second configuration, inserting the adjustment fasteners 418 through a second set of the alignment bores 414 of the front and rear members 406*a*, 406*b* can secure the front and rear members 406*a*, 406*b* to each other such that the left portion 302*a* of the adjustable chair shell 300 defines a second length $L_2$. This process can be similarly performed for any other number of configurations so that the adjustable chair shell 300 defines any other number of lengths. Further, when the adjustable chair shell 300 is in either of the first or second configurations, any number of adjustment fasteners 418 can be inserted through the alignment bores 414 to secure the front and rear members 406*a*, 406*b* to each other. In the depicted embodiment, four adjustment fasteners 418 are used (two on each side of the central rib 408).

Continuing with FIGS. 10-15, the front support assembly 420 of the left portion 302*a* can comprise multiple members that are releasably coupled to each other. As depicted, the front support assembly 420 comprises an upper member 420*a* connected to the arm assembly 453 and a lower member 420*b* connected to the upper member 420*a* and the base assembly 406. Each of the upper and lower members 420*a*, 420*b* is depicted as defining a substantially U-shaped central rib 422, as well as extensions 423 that extend from the inner end of both sides of the central rib 422. Though the front support assembly 420 is depicted and described as having a particular shape, this disclosure is not meant to be limited to such. The rib 422 of each of the upper and lower members 420*a*, 420*b* can include a plurality of gaps 424 that extend through their respective bodies. For example, the central rib 422 of each of the upper and lower members 420*a*, 420*b* of the front support assembly 420 can include at least three elongate, substantially oval gaps 424. Alternatively or in addition, the gaps 424 can be defined through the extensions 423 of the upper and lower members 420*a*, 420*b*. However, more or less gaps 424 are contemplated, as well as gaps 424 having different shapes and sizes. Like the other gaps described herein, the gaps 424 allow the front support assembly 420 to include less material, thus decreasing the overall weight and manufacturing cost associated with the left portion 302*a*.

Each of the upper and lower members 420*a*, 420*b* include a plurality of alignment features positioned in predetermined locations that correspond to predetermined heights of the left portion 302*a* of the adjustable chair shell 300. In the depicted embodiment, the alignment features are a plurality of alignment bores 426 that extend completely through the respective upper and lower members 420*a*, 420*b*. However, other types of alignment features are contemplated, such as slot and groove attachment, press-fit features, ball detents, etc. In particular, the alignment bores 426 are depicted as extending completely through the extensions 423 as well as the central rib 422 of the upper and lower members 420*a*, 420*b*. Each of the alignment bores 426 can be sized to receive an adjustment fastener 429, which can be a screw, bolt, or other suitable fastener. In operation, securing the upper and lower members 420*a*, 420*b* to each other during assembly by inserting the adjustment fasteners 429 through predetermined combinations of the alignment bores 426 can be utilized to adjust the height of the adjustable chair shell 300. In one configuration, the upper and lower members 420*a*, 420*b* can be positioned such that one of the alignment bores 426 of the upper member 420*a* is aligned with one of the alignment bores 426 of the lower member 420*b* in a first configuration. When the upper and lower members 420*a*, 420*b* are in the first configuration, inserting the adjustment fasteners 429 through the a first set of the bores 426 of the upper and lower members 420*a*, 420*b* can secure the upper and lower members 420*a*, 420*b* to each other such that the adjustable chair shell 300 defines a first height H4 (FIG. 14A).

Alternatively, the upper and lower members 420*a*, 420*b* can be positioned such that one of the alignment bores 426 of the upper member 420*a* is aligned with another one of the alignment bores 426 of the lower member 420*b* in a second configuration. When the upper and lower members 420*a*, 420*b* are in the second configuration, inserting the adjustment fasteners 429 through a second set of the alignment bores 426 of the upper and lower members 420*a*, 420*b* can secure the upper and lower members 420*a*, 420*b* to each other such that the adjustable chair shell 300 defines a second height $H_5$. This process can be similarly performed for any other number of configurations so that the adjustable chair shell 300 defines any other number of heights. Further, when the front support assembly 420 is in either of the first or second configurations, any number of adjustment fasteners 429 can be inserted through the alignment bores 426 to secure the upper and lower members 420*a*, 420*b* to each other. In the depicted embodiment, six adjustment fasteners 429 are used (two in the central rib 422, and two in each extension 423 on both sides of the central rib 422).

Opposite the front support assembly 420, the rear support assembly 432 of the left portion 302*a* can comprise multiple members that are releasably coupled to each other. As depicted, the rear support assembly 432 comprises an upper member 432*a* connected to the arm assembly 453 and a lower member 432*b* connected to the upper member 432*a* and the base assembly 406. Each of the upper and lower members 432*a*, 432*b* is depicted as defining a substantially U-shaped central rib 434, as well as extension 435 that extend from the inner end of both sides of the central rib 434. Though the rear support assembly 432 is depicted and described as having a particular shape, this disclosure is not meant to be limited to such. The rib 434 of each of the upper and lower members 432*a*, 432*b* can include a plurality of gaps 437 that extend through their respective bodies. For example, the central rib 434 of each of the upper and lower members 432*a*, 432*b* of the rear support assembly 432 can include at least two elongate, substantially oval gaps 437. Alternatively or in addition, the gaps 437 can be defined through the extensions 435 of the upper and lower members 432*a*, 432*b*. However, more or less gaps 437 are contemplated, as well as gaps 437 having different shapes and sizes. Like the other gaps described herein, the gaps 437 allow the rear support assembly 432 to include less material, thus decreasing the overall weight and manufacturing cost associated with the left portion 302*a*.

Each of the upper and lower members 432*a*, 432*b* includes a plurality of alignment features positioned in predetermined locations that correspond to predetermined heights of the left portion 302*a* of the adjustable chair shell 300. In the depicted embodiment, the alignment features are a plurality of alignment bores 440 that extend completely through the respective upper and lower members 432*a*, 432*b*. However, other types of alignment features are contemplated, such as slot and groove attachment, press-fit features, ball detents, etc. In particular, the alignment bores 440 are depicted as extending completely through the extensions 435 as well as the central rib 434 of the upper and lower members 432*a* 432*b*. Each of the alignment bores 440 can be sized to receive an adjustment fastener 443, which can be a screw, bolt, or other suitable fastener. In operation, securing the upper and lower members 432*a*, 432*b* to each other during assembly by inserting the adjustment fasteners 443 through predetermined combinations of the alignment bores 440 can be utilized to adjust the height of the left portion 302*a* of the adjustable chair shell 300. In one configuration, the upper and lower members 432*a*, 432*b* can be positioned such that one of the alignment bores 440 of the upper member 432*a* is aligned with one of the alignment bores 440 of the lower member 432*b* in a first configuration. When the upper and lower members 432*a*, 432*b* are in the first configuration, inserting the adjustment fasteners 443 through a first set of the bores 440 of the upper and lower members 432*a*, 432*b* can secure the upper and lower members 432*a*, 432*b* to each other such that the adjustable chair shell 300 defines a first height H4 (FIG. 14A).

Alternatively, the upper and lower members 432*a*, 432*b* can be positioned such that one of the alignment bores 440 of the upper member 432*a* is aligned with another one of the alignment bores 440 of the lower member 432*b* in a second configuration. When the upper and lower members 432*a*, 432*b* are in the second configuration, inserting the adjustment fasteners 443 through a second set of the alignment bores 440 of the upper and lower members 432*a*, 432*b* can secure the upper and lower members 432*a*, 432*b* to each other such that the left portion 302*a* of the adjustable chair shell 300 defines a second height $H_5$. This process can be similarly performed for any other number of configurations so that the adjustable chair shell 300 defines any other number of heights. Further, when the front support assembly 432 is in either of the first or second configurations, any number of adjustment fasteners 443 can be inserted through the alignment bores 440 to secure the upper and lower members 432*a*, 432*b* to each other. In the depicted embodiment, six adjustment fasteners 443 are used (two in the central rib 434, and two in each extension 435 on both sides of the central rib 434).

Continuing with FIGS. 10-15, opposite the base assembly 406 of the left portion 302*a*, the arm assembly 453 can comprise multiple members that are releasably coupled to each other. As depicted, the arm assembly 453 comprises a front arm 454 connected to the front support assembly 420 and a rear arm 452 connected to the front arm 454 and the rear support assembly 432. Each of the front and rear arms 454, 452 is depicted as including two separate, I-shaped portions spaced apart along the lateral direction 2. The front arm 454 includes a left member 454*a* and a right member 454*b* spaced from the left member 454*a* along the lateral direction 2, while the rear arm 452 includes a left member 452*a* and a right member 452*b* spaced from the left member 452*a* along the lateral direction 2. The left and right members 454*a*, 454*b* of the front arm 454 and the left and right members 452*a*, 452*b* of the rear arm 452 can be connected by connectors 460 that extend along the lateral direction 2 and are spaced apart along the longitudinal direction 1 to provide added stability to the arm assembly 453. Alternatively, the use of stabilizing means other than the connectors 460 is contemplated. The left member 454*a* of the front arm 454 is attached to the left member 452*a* of the rear arm 452, while the right member 454*b* of the front arm 454 is attached to the right member 452*b* of the rear arm 452. Though each of the left and right members 454*a*, 454*b*, 452*a*, 452*b* of the front and rear arms 454, 452 is depicted and described as having a particular shape, this disclosure is not meant to be limited to such. Each of the left and right members 454*a*, 454*b*, 452*a*, 452*b* of the front and rear arms 454, 452 can include a plurality of gaps 458 that extend laterally through their respective bodies. For example, each of the left and right members 454*a*, 454*b*, 452*a*, 452*b* of the arm assembly 453 can include at least six elongate, substantially oval gaps 458. However, more or less gaps 458 are contemplated, as well as gaps 458 having different shapes and sizes. Like the other gaps described herein, the gaps 458 allow the arm assembly 453 to include less material, thus decreasing the overall weight and manufacturing cost associated with the left portion 302*a*.

Each of the left and right members 454*a*, 454*b*, 452*a*, 452*b* of the front and rear arms 454, 452 includes a plurality of alignment features positioned in predetermined locations that correspond to predetermined lengths of the left portion 302*a* of the adjustable chair shell 300. In the depicted embodiment, the alignment features are a plurality of alignment bores 463 that extend completely through the top and bottom portions of the left and right members 454*a*, 454*b*, 452*a*, 452*b*. However, other types of alignment features are contemplated, such as slot and groove attachment, press-fit features, ball detents, etc. Each of the alignment bores 463 can be sized to receive an adjustment fastener 466, which can be a screw, bolt, or other suitable fastener. In operation, securing the left and right members 454*a*, 454*b*, 452*a*, 452*b* to each other during assembly by inserting the adjustment fasteners 466 through predetermined combinations of the alignment bores 463 can be utilized to adjust the length of the left portion 302*a* of the adjustable chair shell 300. In one configuration, the front and rear arms 454, 452 can be positioned such that one of the alignment bores 463 of the left member 454*a* is aligned with one of the alignment bores 463 of the left member 452*a* and one of the alignment bores 463 of the right member 454*b* is aligned with one of the alignment bores 463 of the right member 452*b* in a first configuration. When the front and rear arms 454, 452 are in the first configuration, inserting the adjustment fasteners 466 through a first set of the alignment bores 463 of the front and rear arms 454, 452 can secure the front and rear arms 454, 452 to each other such that the left portion 302*a* of the adjustable chair shell 300 defines a first length $L_1$ (FIGS. 13A and 14A).

Alternatively, the front and rear arms 454, 452 can be positioned such that one of the alignment bores 463 of the left member 454*a* is aligned with another one of the alignment bores 463 of the left member 452*a* and one of the alignment bores 463 of the right member 454*b* is aligned with another one of the alignment bores 463 of the right member 452*b* in a second configuration. When the front and rear arms 454, 452 are in the second configuration, inserting the adjustment fasteners 466 through a second set of the alignment bores 463 of the front and rear arms 454, 452 can secure the front and rear arms 454, 452 to each other such that the left portion 302*a* of the adjustable chair shell 300 defines a second length $L_2$. This process can be similarly performed for any other number of configurations so that the left portion 302*a* of the adjustable chair shell 300 defines any other number of lengths. In the depicted embodiment, eight fasteners 466 are used to secure the front and rear arms 452, 454 to each other. However, any number of adjustment fasteners 466 can be inserted through the alignment bores 463 to secure the front and rear arms 454, 452 to each other.

Between the arm assembly 453 and the base assembly 406, the central support assembly 444 of the left portion 302*a* extends from the front support assembly 420 to the rear support assembly 432. The central support assembly 444, like the other components of the left portion 302*a*, can comprise multiple members that are releasably coupled to each other. As depicted, the central support assembly 444 comprises a front member 444*a* connected to the front support assembly 420 and a rear member 444*b* connected to the front member 444*a* and the rear support assembly 432. Each of the front and rear members 444*a*, 444*b* is depicted as defining a substantially U-shaped central rib 445, as well as extensions 447 that extend from the lower end of both sides of the central rib 445. Though the central support assembly 444 is depicted and described as having a particular shape, this disclosure is not meant to be limited to such. The rib 445 of each of the front and rear members 444*a*, 444*b* can include a plurality of gaps 448 that extend through their respective bodies. For example, the central rib 445 of each of the front and rear members 444*a*, 444*b* of the central support assembly 444 can include at least eight elongate, substantially oval gaps 448. Alternatively or in addition, the gaps 448 can be defined through the extensions 447 of the front and rear members 444*a*, 444*b*. However, more or less gaps 448 are contemplated, as well as gaps 448 having different shapes and sizes. Like the other gaps described herein, the gaps 448 allow the central support assembly 444 to include less material, thus decreasing the overall weight and manufacturing cost associated with the left portion 302*a*.

Each of the front and rear members 444*a*, 444*b* of the central support assembly 444 includes a plurality of alignment features positioned in predetermined locations that correspond to predetermined lengths of the left portion 302*a* of the adjustable chair shell 300. In the depicted embodiment, the alignment features are a plurality of alignment bores 450 that extend completely through the respective front and rear members 444*a*, 444*b*. However, other types of alignment features are contemplated, such as slot and groove attachment, press-fit features, ball detents, etc. In particular, the alignment bores 450 are depicted as extending completely through the extensions 447 of the front and rear members 444*a*, 444*b*, though it is contemplated that the alignment bores 450 can also be defined by the central rib 445. Each of the alignment bores 450 can be sized to receive an adjustment fastener 451, which can be a screw, bolt, or other suitable fastener. In operation, securing the front and rear members 444*a*, 444*b* to each other during assembly by inserting the adjustment fasteners 451 through predetermined combinations of the alignment bores 450 can be utilized to adjust the length of the left portion 302*a* of the adjustable chair shell 300. In one configuration, the front and rear members 444*a*, 444*b* can be positioned such that one of the alignment bores 450 of the front member 444*a* is aligned with one of the alignment bores 450 of the rear member 444*b* in a first configuration. When the front and rear members 444*a*, 444*b* are in the first configuration, inserting the adjustment fasteners 451 through the bores 450 of the front and rear members 444*a*, 444*b* can secure the front and rear members 444*a*, 444*b* to each other such that the left portion 302*a* of the adjustable chair shell 300 defines a first length $L_1$ (FIGS. 13A and 14A).

Alternatively, the front and rear members 444*a*, 444*b* can be positioned such that one of the alignment bores 450 of the front member 444*a* is aligned with another one of the alignment bores 450 of the rear member 444*b* in a second configuration. When the front and rear members 444*a*, 444*b* are in the second configuration, inserting the adjustment fasteners 451 through the alignment bores 450 of the front and rear members 444*a*, 444*b* can secure the front and rear members 444*a*, 444*b* to each other such that the left portion 302*a* of the adjustable chair shell 300 defines a second length $L_2$. This process can be similarly performed for any other number of configurations so that the adjustable chair shell 300 defines any other number of lengths. Further, when the left portion 302*a* of the adjustable chair shell 300 is in either of the first or second configurations, any number of adjustment fasteners 451 can be inserted through the alignment bores 450 to secure the front and rear members 444*a*, 444*b* to each other. In the depicted embodiment, four adjustment fasteners 451 are used (two on each side of the central rib 445).

The left portion 302*a* of the adjustable chair shell 300 can further include a support 470 attached to the inner side of the left portion 302*a*. The left portion 302*a* can include connecting bars 474*a*, 474*b* that can be positioned at the outer side of each longitudinal end of the support 470 to connect the support 470 to the central support assembly 444. Specifically, the connecting bar 474*a* can be positioned between the support 470 and the front member 444*a* of the central support assembly 444, while the connecting bar 474*b* can be positioned between the support 470 and the rear member 444*b* of the central support assembly 444. Fasteners 478 can be utilized to attach the support 470 to the central support assembly 444 via the connecting bars 474*a*, 474*b*, though other methods of attachment are also contemplated. The support 470 can be utilized to attach the adjustable chair shell 300 to other portions of the lift chair, such as the lift mechanism (not shown) or the adjustable seat 10. The support 470 can also have different embodiments, such as the support 470' shown in FIGS. 13A and 14A.

Figure 15:
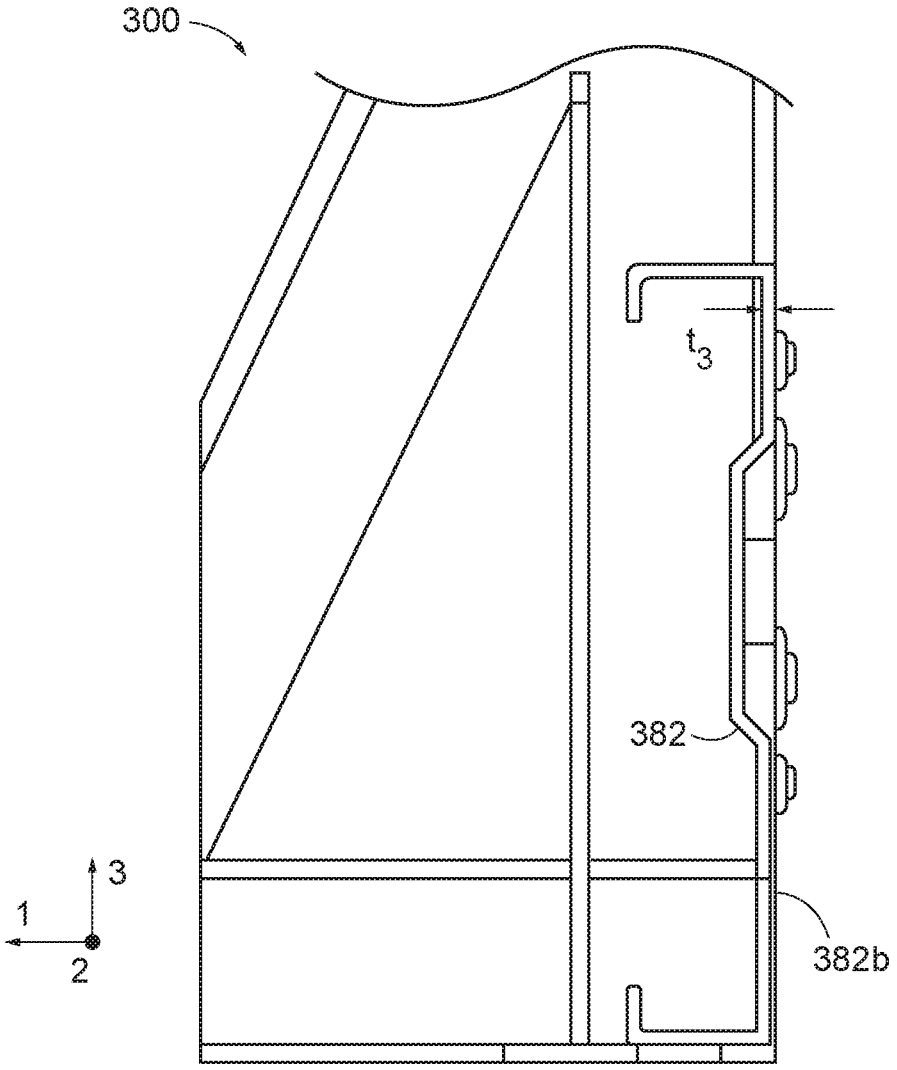
FIG. 15 is a cross-sectional view of the adjustable chair shell shown in FIG. 10, taken along line 15-15 shown in FIG. 13B.

Referring to FIG. 15, a cross-sectional view of the right member 382*b* of the central portion 302*c* of the adjustable chair shell 300 is shown in cross section. As shown, the right member 382*b* can define a thickness $t_3$ that extends in the longitudinal direction 1. The thickness $t_3$ can be from about 0.8 mm to about 1.2 mm. For example, in one embodiment the thickness $t_3$ is about 0.8 mm. In another embodiment, the thickness $t_3$ can be about 1.2 mm. Though the thickness of the right member 382*b* is explicitly shown, each of the other portions of the adjustable chair shell 300 can define a similar thickness $t_3$. Also, each element of the adjustable chair shell 300 can be comprised of a stamped and/or bent sheet metal. For example, each component of the adjustable chair shell 300 can be comprised of steel. Different metals and thicknesses can be utilized in the adjustable chair shell 300, so long as the moment of inertia provides sufficient bending strength.

As described above, the various components of the adjustable seat 10, adjustable back 100, and adjustable chair shell 300 provide the ability to adjust the height, width, and length of various aspects of the lift chair frame. Each of the above-described adjustments to the height, width, and length can be performed individually, or in combination with any of the other described adjustments. The ability to adjust the various dimensions of the lift chair frame allows the production of a standardized lift chair frame that can be adjusted and adapted to produce different lift chair models. In contrast, without the ability to adjust a lift chair frame, each individual model of lift chair having different dimensions must be separately manufactured, which can increase costs and overall manufacturing complexity.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts, and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features, and concepts may be expressly identified herein as being inventive or forming part of an invention, such identification is not intended to be exclusive, but rather there may be inventive aspects, concepts, and features that are fully described herein without being expressly identified as such or as part of a specific invention, the scope of the inventions instead being set forth in the appended claims or the claims of related or continuing applications. Descriptions of exemplary methods or processes are not limited to inclusion of all steps as being required in all cases, nor is the order that the steps are presented to be construed as required or necessary unless expressly so stated.

While the invention is described herein using a limited number of embodiments, these specific embodiments are not intended to limit the scope of the invention as otherwise described and claimed herein. The precise arrangement of various elements and order of the steps of articles and methods described herein are not to be considered limiting. For instance, although the steps of the methods are described with reference to sequential series of reference signs and progression of the blocks in the figures, the method can be implemented in a particular order as desired. Further, while context for the structure and function disclosed herein has been provided by referring to advantages of the adjustable structure, the present invention is not intended to be limited to a solution or any particular problem nor to any advantage, unless expressly stated in the claims.

What is claimed is:

1. A lift chair frame, comprising:

an adjustable seat including a front support bar assembly including a left member and a right member connected to the left member, a rear support bar assembly opposite the front support bar assembly along a longitudinal direction, a left support bar connected to the front and rear support bar assemblies, and a right support bar opposite the left support bar along a lateral direction that is perpendicular to the longitudinal direction and connected to the front and rear support bar assemblies; and an adjustable back coupled to the adjustable seat, wherein each of the left and right members includes a plurality of alignment features positioned in predetermined locations that correspond to predetermined adjustable seat widths, such that during assembly one of the predetermined adjustable seat widths is achieved when one of the alignment features of the left member is aligned with one of the alignment features of the right member, and the left member is secured to the right member.

2. The lift chair frame of claim 1, wherein the rear support bar assembly comprises a left member connected to the left support bar and a right member connected to the right support bar, wherein each of the left and right members of the rear support bar assembly includes a plurality of alignment features positioned in predetermined locations that correspond to the predetermined adjustable seat widths, such that during assembly one of the predetermined adjustable seat widths is further achieved when one of the alignment features of the left member of the rear support bar assembly is aligned with one of the alignment features of the right member of the rear support bar assembly, and the left member of the rear support bar assembly is secured to the right member of the rear support bar assembly.

3. The lift chair frame of claim 2, wherein the plurality of alignment features of the front and rear support bar assemblies comprise a plurality of alignment bores configured to receive fasteners for securing the respective left and right members together.

4. The lift chair frame of claim 1, wherein the left support bar has an inner side, an outer side opposite the inner side, and a thickness measured from the inner side to the outer side along the lateral direction, the thickness being from about 0.8 mm to about 1.2 mm.

5. The lift chair frame of claim 4, wherein the thickness of the left support bar is about 0.8 mm.

6. The lift chair frame of claim 4, wherein the thickness of the left support bar is about 1.2 mm.

7. The lift chair frame of claim 1, wherein the adjustable back comprises a top support bar assembly, a bottom support bar assembly opposite the top support bar assembly along a vertical direction that is perpendicular to the lateral and longitudinal directions, a left support bar connected to the top and bottom support bar assemblies, and a right support bar opposite the left support bar along the lateral direction and connected to the top and bottom support bar assemblies, wherein the adjustable back has a first width measured from the left support bar to the right support bar along the lateral direction and a first height measured from the top support bar assembly to the bottom support bar assembly along the vertical direction.

8. The lift chair frame of claim 7, wherein the adjustable back includes an upper wing releasably attachable to the top support bar assembly, such that the adjustable back has a second height measured from the upper wing to the bottom support bar assembly along the vertical direction that is greater than the first height when the upper wing is attached to the top support bar assembly.

9. The lift chair frame of claim 7, wherein the adjustable back includes a left wing releasably attachable to the left support bar and a right wing releasably attachable to the right support bar, such that the adjustable back has a second width measured from the left wing to the right wing along the lateral direction that is greater than the first width when the left wing is attached to the left support bar and the right wing is attached to the right support bar.

10. The lift chair frame of claim 7, wherein the adjustable back includes a left wing releasably attachable to the left support bar and a right wing releasably attachable to the right support bar, such that the adjustable back has a second width measured from the left wing to the right wing along the lateral direction that is greater than the first width when the left wing is attached to the left support bar and the right wing is attached to the right support bar, wherein the adjustable back further includes an upper wing releasably attachable to the left and right wings, such that the adjustable back has a second height measured from the upper wing to the bottom support bar assembly along the vertical direction that is greater than the first height when the upper wing is attached to the left and right wings.

11. The lift chair frame of claim 1, wherein the lift chair frame is comprised of metal.

12. The lift chair frame of claim 11, wherein the metal is a steel.

13. A lift chair frame, comprising:

an adjustable back comprising a top support bar assembly, a bottom support bar assembly opposite the top support bar assembly along a vertical direction, a left support bar connected to the top and bottom support bar assemblies, and a right support bar opposite the left support bar along a lateral direction that is perpendicular to the vertical direction and connected to the top and bottom support bar assemblies, wherein the adjustable back has a first width measured from the left support bar to the right support bar along the lateral direction and a first height measured from the top support bar assembly to the bottom support bar assembly along the vertical direction;

an adjustable seat coupled to the adjustable back;

an adjustable chair shell coupled to the adjustable seat;

a left wing releasably attachable to the left support bar of the adjustable back; and a right wing releasably attachable to the right support bar of the adjustable back, wherein the adjustable back has a second width measured from the left wing to the right wing along the lateral direction when the left wing is attached to the left support bar and the right wing is attached to the right support bar, the second width being greater than the first width.

14. The lift chair frame of claim 13, wherein the adjustable back further includes an upper wing releasably attachable to the left and right wings, such that the adjustable back has a second height measured from the upper wing to the bottom support bar assembly along the vertical direction that is greater than the first height when the upper wing is attached to the left and right wings.

15. The lift chair frame of claim 13, wherein the adjustable chair shell includes a left portion, a right portion opposite the left portion along the lateral direction, and a rear portion that attaches the left portion to the right portion, wherein the adjustable seat is attached to an inner side of the left portion and an inner side of the right portion.

16. The lift chair frame of claim 15, wherein the rear portion includes a left member and a right member connected to the left member, each of the left and right members including a plurality of alignment features positioned in predetermined locations that correspond to predetermined adjustable chair shell widths, such that during assembly one of the predetermined adjustable chair shell widths is achieved when one of the alignment features of the left member is aligned with one of the alignment features of the right member, and the left member is secured to the right member.

17. The lift chair frame of claim 16, wherein the plurality of alignment features of the left and right members comprise a plurality of alignment bores configured to receive fasteners for securing the left and right members together.

18. The lift chair frame of claim 15, wherein the left and right portions each comprise a front support assembly, a rear support assembly opposite the front support assembly along a longitudinal direction that is perpendicular to the vertical and lateral directions, a base assembly connected to the front and rear support assemblies, and an arm assembly opposite the base assembly along the vertical direction that connects to the front and rear support assemblies.

19. The lift chair frame of claim 18, wherein the front and rear support assemblies of each of the left and right portions include an upper member and a lower member connected to the upper member, each of the upper and lower members including a plurality of alignment features positioned in predetermined locations that correspond to predetermined adjustable chair shell heights, such that during assembly, independent and predetermined heights is achieved for each of the left and right portions when one of the alignment features of the upper member is aligned with one of the alignment features of the lower member for the front and rear support assemblies of the left and right portions, and the upper members are secured to the respective lower members.

20. The lift chair frame of claim 13, wherein the left support bar has an inner side, an outer side opposite the inner side, and a thickness measured from the inner side to the outer side along the lateral direction, the thickness being from about 0.8 mm to about 1.2 mm.

21. A lift chair frame, comprising:

an adjustable back comprising a top support bar assembly, a bottom support bar assembly opposite the top support bar assembly along a vertical direction, a left support bar connected to the top and bottom support bar assemblies, and a right support bar opposite the left support bar along a lateral direction that is perpendicular to the vertical direction and connected to the top and bottom support bars, wherein the adjustable back has a first width measured from the left support bar to the right support bar along the lateral direction and a first height measured from the top support bar assembly to the bottom support bar along the vertical direction;

a left wing releasably attachable to the left support bar of the adjustable back;

a right wing releasably attachable to the right support bar of the adjustable back, wherein the adjustable back has a second width measured from the left wing to the right wing along the lateral direction when the left wing is attached to the left support bar and the right wing is attached to the right support bar, the second width being greater than the first width;

an adjustable seat including a front support bar assembly including a left member and a right member connected to the left member, a rear support bar assembly opposite the front support bar assembly along a longitudinal direction, a left support bar connected to the front and rear support bar assemblies, and a right support bar opposite the left support bar along a lateral direction that is perpendicular to the longitudinal direction and connected to the front and rear support bar assemblies, wherein each of the left and right members includes a plurality of alignment features positioned in predetermined locations that correspond to predetermined adjustable seat widths, such that during assembly one of the predetermined adjustable seat widths is achieved when one of the alignment features of the left member is aligned with one of the alignment features of the right member, and the left member is secured to the right member; and an adjustable chair shell including a left portion, a right portion opposite the left portion along the lateral direction, and a rear portion that attaches the left portion to the right portion, wherein the adjustable seat is attached to an inner side of the left portion and an inner side of the right portion, wherein the rear portion includes a left member and a right member connected to the left member, each of the left and right members of the rear portion including a plurality of alignment features positioned in predetermined locations that correspond to predetermined adjustable chair shell widths, such that during assembly one of the predetermined adjustable chair shell widths is achieved when one of the alignment features of the left member is aligned with one of the alignment features of the right member, and the left member is secured to the right member.

22. The lift chair frame of claim 21, wherein the left support bar of the adjustable back has an inner side, an outer side opposite the inner side, and a thickness measured from the inner side to the outer side along the lateral direction, the thickness being from about 0.8 mm to about 1.2 mm.

23. The lift chair frame of claim 21, wherein the left support bar of the adjustable seat has an inner side, an outer side opposite the inner side, and a thickness measured from the inner side to the outer side along the lateral direction, the thickness being from about 0.8 mm to about 1.2 mm.

24. The lift chair frame of claim 21, wherein the left and right portions each comprise a front support assembly, a rear support assembly opposite the front support assembly along a longitudinal direction that is perpendicular to the vertical and lateral directions, a base assembly connected to the front and rear support assemblies, and an arm assembly opposite the base assembly along the vertical direction that connects to the front and rear support assemblies.

25. The lift chair frame of claim 24, wherein the front and rear support assemblies of each of the left and right portions include an upper member and a lower member connected to the upper member, each of the upper and lower members including a plurality of alignment features positioned in predetermined locations that correspond to predetermined adjustable chair shell heights, such that during assembly, independent and predetermined heights are achieved for each of the left and right portions when one of the alignment features of the upper member is aligned with one of the alignment features of the lower member for the front and rear support assemblies of the left and right portions, and the upper members are secured to the respective lower members.

* * * * *